US007124075B2

(12) United States Patent
Terez

(10) Patent No.: US 7,124,075 B2
(45) Date of Patent: Oct. 17, 2006

(54) METHODS AND APPARATUS FOR PITCH DETERMINATION

(76) Inventor: Dmitry Edward Terez, 6 North 9th St., Millville, NJ (US) 08332

( * ) Notice: Subject to any disclaimer, the term of this patent is extended or adjusted under 35 U.S.C. 154(b) by 935 days.

(21) Appl. No.: 10/140,211

(22) Filed: May 7, 2002

(65) Prior Publication Data

US 2003/0088401 A1 May 8, 2003

Related U.S. Application Data

(60) Provisional application No. 60/348,883, filed on Oct. 26, 2001.

(51) Int. Cl.
*G10L 11/04* (2006.01)

(52) U.S. Cl. ..... 704/203; 704/207

(58) Field of Classification Search ..... 704/200, 704/203, 204, 205, 206, 207
See application file for complete search history.

(56) References Cited

U.S. PATENT DOCUMENTS

| | | | | |
|---|---|---|---|---|
| 2,908,761 | A | 10/1959 | Raisbeck | |
| 3,405,237 | A | 10/1968 | David et al. | |
| 3,496,465 | A | 2/1970 | Schroeder | |
| 3,535,454 | A * | 10/1970 | Miller | 704/268 |
| 3,566,035 | A | 2/1971 | Nol et al. | |
| 3,649,765 | A | 3/1972 | Rabiner et al. | |
| 3,740,476 | A | 6/1973 | Atal | |
| 3,916,105 | A | 10/1975 | McCray | |
| 4,015,088 | A | 3/1977 | Dubnowski et al. | |
| 4,653,098 | A | 3/1987 | Nakata et al. | |
| 4,672,667 | A * | 6/1987 | Scott et al. | 704/231 |
| 4,879,748 | A | 11/1989 | Picone et al. | |
| 5,226,108 | A | 7/1993 | Hardwick et al. | |
| 5,960,387 | A * | 9/1999 | Rapp et al. | 704/207 |
| 6,018,706 | A | 1/2000 | Huang et al. | |
| 6,026,357 | A | 2/2000 | Ireton et al. | |
| 6,035,271 | A | 3/2000 | Chen | |
| 6,047,254 | A | 4/2000 | Ireton et al. | |
| 6,199,035 | B1 | 3/2001 | Lakaniemi et al. | |
| 6,208,958 | B1 | 3/2001 | Cho et al. | |
| 6,216,118 | B1 | 4/2001 | Iokibe et al. | |
| 6,226,606 | B1 | 5/2001 | Acero et al. | |

(Continued)

OTHER PUBLICATIONS

Dogan M C et al: "Real-time robust pitch Detector" Digital Signal Processing, Mar. 23, Vol. vol. 5 CONF, 17, Mar. 23, 1992, pp. 129-132, XP010058699 ISBN: 0-7803-0532-9.

(Continued)

*Primary Examiner*—Martin Lerner
(74) *Attorney, Agent, or Firm*—Straub and Pokotylo; Michael P. Straub

(57) ABSTRACT

Methods and apparatus for detecting periodicity and/or for determining the fundamental period of a signal such as speech. The methods include embedding a portion of a sampled digitized signal into an m-dimensional state space to obtain a sequence of m-dimensional vectors, selecting closest pairs of vectors in state space from a plurality of possible pairs of m-dimensional vectors in said sequence of m-dimensional vectors, accumulating total numbers of selected closest pairs of vectors having the same time separation values to produce a histogram of accumulated numbers, and locating at least a highest peak in a portion of said histogram to obtain a value indicating the fundamental period of the signal. Various embodiments are directed to speech and audio signal processing and other speech related applications. However, the methods have a general nature and can be applied to other types of periodic or quasi-periodic signals as well.

62 Claims, 16 Drawing Sheets

U.S. PATENT DOCUMENTS 6,502,067 B1 * 12/2002 Hegger et al. ..... 704/216
6,584,437 B1 * 6/2003 Heikkinen et al. ..... 704/207

OTHER PUBLICATIONS

Banbrook M et al: "Is speech chaotic?: invariant geometrical measures for speech data" IEE Colloquium on ' Exploiting Chaos in Signal Processing (Digest No. 1994/143), 1994, pp. 8/1-8/10, XP006527363 London.

Banbrook M et al: "Speech Characterization and Synthesis by Noninear Methods" IEEE Transactions on Speech and Audio Processing, IEEE Inc. New York, US, vol. 7, No. 1, Jan. 1999, pp. 1-17, XP000890820 ISSN: 1063-6676.

Supplementary European Search Report for Application No.: EP 02 78 4117, Oct. 4, 2005, 1 Pg.

F. Takens, "Detecting Strange Attractors in Turbulence", Lecture Notes in Mathematics, v. 898, , pp. 336-381, eds. D. Rand and L. S. Young, Springer, Berlin, (1981).

D. Bromhead and G. King, "Extracting Qualitative Dynamics from Experimental Data", Physica 20D, pp. 217-236, North-Holland, Amsterdam (1986).

D. Lathrop and E. Kostelich, "Characterization of an Experimental Strange Attractor by Periodic Orbits", Physical Review A., v. 40, No. 7, pp. 4028-4031, (Oct. 1, 1989).

W. Hess, "Pitch and Voicing Determination", Advances in Speech Signaling Processing, , pp. 3-47, eds. M. M. Sondhi and S. Furui, Marcel Dekker, New York. (1991).

A. Provenzale et al., "Distinguishing Between Low-dimensional Dynamics and Radomness in Measured Time Series", Physica D 58, pp. 31-49, North Holland, (1992).

C. Gilmore, "A New Test for Chaos", Journal of Economic Behavior and Organization 22, pp. 209-237, Elsevier Science Publishers B.V., (1993).

T. Schreiber, "Efficient Neighbor Searching in Nonlinear Time Series Analysis", Dept. of Theoretical Physics, Univ. of Wuppertal, D-42097 Wuppertal, pp. 1-20, (Jul. 18, 1996).

D. Talkin, "A Robust Algorithm for Pitch Tracking (RAPT)", Speech Coding and Synthesis, pp. 495-518, Elsevier Science Publishers B.V., (1995).

G. Kubin, "Nonlinear Processing of Speech", Speech Coding and Synthesis, pp. 557-610, Elsevier Science Publishers B.V., (1995).

H. Kantz and T. Schreiber, "Nonlinear Time Analysis", Cambridge University Press, pp. 3-304, (1998).

I. Mann and S. McLaughlin, "A Nonlinear Algorithm for Epoch Marking in Speech Signals Using Poincare Maps", Proceedings of the 9th European Signal Processing Conference, V. 2, pp. 701-704,. (1998).

R. Gilmore, "Topological Analysis of Chaotic Dynamical Systems", Reviews of Modern Physics, v. 70, No. 4, pp. 1455-1529, (Oct. 1998).

D. Gerhard, "Audio visualization in phase space", in "Bridges: Mathematical Connections in Art, Music and Science", 1999, pp. 137-144, as downloaded from http://citeseer.ist.psu.edu/283762.html in 2003.

D. Gerhard, "Audio visualization in phase space", in "Bridges: Mathematical Connections in Art, Music and Science", 1999, pp. 137-144, as downloaded from http://citeseer.ist.psu.edu/gerhard99audio.html in Feb. 2006.

* cited by examiner

METHODS AND APPARATUS FOR PITCH DETERMINATION

RELATED APPLICATIONS

The present application claims the benefit of U.S. Provisional Patent Application Ser. No. 60/348,883, filed Oct. 26, 2001.

FIELD OF THE INVENTION

The present invention relates generally to a signal processing and, more particularly, to methods and apparatus for detecting periodicity and/or for determining the fundamental frequency of a signal, for example, a speech signal.

BACKGROUND OF THE INVENTION

A problem frequently encountered in many signal processing applications is to determine whether a portion of a signal is periodic or aperiodic and, in case it is found to be periodic, to measure the period length. This task is particularly important in processing acoustic signals, like human speech or music. In the case of such signals, the term "pitch" is used to refer to a fundamental frequency of a periodic or quasi-periodic signal. The fundamental frequency may be, e.g., a frequency, which may be perceived as a distinct tone by the human auditory system.

Although human pitch perception by itself is an auditory phenomenon, it generally correlates very well with a measured fundamental frequency of a signal. Fundamental frequency, or F0, is defined as the inverse of the fundamental period for some portion of a signal.

Pitch in human speech is manifested by nearly repeating waveforms in periodic "voiced" portions of speech signals, and the period between these repeating waveforms defines the pitch period. Such voiced speech sounds are produced by periodic oscillations of human vocal cords, which provide a source of periodic excitation for the vocal tract. Unvoiced portions of speech signals are produced by other, non-periodic, sources of excitation and normally do not exhibit any periodicity in a signal waveform.

In speech signal processing, accurate pitch and voicing estimation plays a very important role in speech compression, speech recognition, speech synthesis and many other applications. Pitch determination of speech signals has been a subject of intense research for over forty years. It is generally considered one of the most pervasive and difficult problems in speech analysis. A large number of methods for pitch determination have been developed to date, but so far no definitive solution has emerged. An article by W. Hess provides a survey of the many existing pitch determination methods (Hess, W., "Pitch and voicing determination", in *Advances in speech signal processing*, eds. M. M. Sondhi and S. Furui, Marcel Dekker, New York, 1991, pp. 3–48). According to this survey, the majority of well-known pitch-determination methods can be classified as either short-term analysis or time-domain methods. The more reliable and popular techniques in use today are short-term analysis methods, operating on short portions, or frames, of a speech signal.

At present, most of the conventional short-term pitch-determination methods belong to one of the following three groups: (1) methods based on auto- or cross-correlation of a signal, (2) frequency-domain methods analyzing harmonic structure of a signal spectrum and (3) methods based on cepstrum calculation.

None of these conventional methods, however, was found fully satisfactory for all types of speech signals under realistic conditions, as all of them suffer from serious inherent limitations. For example, correlation-based pitch determination has one major drawback—the presence of secondary peaks due to speech formants (vocal tract resonances), in addition to main peaks corresponding to pitch period and its multiples. This property of the correlation function makes the selection of correct peaks very difficult. In order to circumvent this difficulty some sophisticated post-processing techniques, like dynamic programming, are commonly used to select proper peaks from computed correlation functions and to produce correct pitch contours. For example, a well-known and presently considered "state-of-the-art" pitch-tracking algorithm, which was implemented in ESPS/Waves+ software package, uses normalized cross-correlation and dynamic programming (Talkin, D., "A robust algorithm for pitch tracking (RAPT)" in *Speech Coding and Synthesis*, Elsevier, 1995, pp. 495–518). However, the drawbacks of correlation-based approaches are inherent in the very nature of a correlation function and, therefore, cannot be avoided. On the other hand, correlation-based methods are general in nature and can be applied to all kinds of signals. Correlation is also relatively immune to noise. At present, correlation-based methods for pitch and periodicity estimation are widely employed in speech coding standards for mobile phones and other speech communication devices.

Cepstrum-based methods are not particularly sensitive to speech formants, but tend to be rather sensitive to noise. In addition, a cepstrum-based approach lacks generality: it fails for some simple periodic signals. A cepstrum-based approach is unable to determine the fundamental period of an extremely band-limited signal, such as pure sine wave. However, some speech sounds are extremely band-limited and, therefore, cepstrum-based pitch detectors would fail in such instances, i.e., they would fail on an otherwise clearly periodic signal with a well-defined pitch.

Likewise, frequency-domain pitch-determination methods run into difficulties when the fundamental frequency component is actually missing in a signal, which is often the case with telephone-quality speech signals.

Hence, there is a great need for a new pitch determination method that is general in nature, reliable, accurate, and can overcome the limitations of current techniques.

One can think of the following desirable characteristics of an "ideal" (short-term) pitch-determination method.

It should not suffer from the effects associated with speech formants (vocal tract resonances).

It should be general in nature to work for all kinds of phase-distorted and band-limited signals, including the case of extremely band-limited signals (e.g. pure sine wave) and the case of a missing fundamental frequency component.

It should be able to approach a theoretical resolution limit of the time-domain methods. This means, in particular, that it should be capable of measuring a fundamental period using a portion of a signal a little longer than one complete period, at least for clean periodic signals.

It should be resistant to noise.

Evidently, none of the pitch-determination methods in use today comes anywhere close to possessing all of these characteristics. One of the reasons for such deficiency is a linear nature of signal processing employed by conventional short-term pitch-determination methods.

Speech generation by a human vocal apparatus, meanwhile, is a very complex nonlinear and non-stationary process, of which there is only an incomplete understanding. To achieve a complete and precise understanding of human speech production, it needs to be described in terms of nonlinear fluid dynamics. Unfortunately, this kind of description cannot be used directly for building signal processing devices. Traditionally, though, speech production has been described in terms of a source-filter model, which gives a good approximation for many purposes, but is inherently limited in its ability to model the true dynamics of speech production.

Therefore, it can be advantageous to dismiss conventional linear techniques, like spectral analysis and source-filter model, and to use a more general nonlinear approach, in order to describe the dynamics of human speech production.

Without making too many simplifying assumptions about speech production, one can state that (voiced) speech is generated by a relatively low-dimensional nonlinear dynamical system. The number of active degrees of freedom of this system and its internal state variables change rapidly over time and are not observable directly. The key issue, then, is how to recover and describe the underlying low-dimensional dynamics from a single one-dimensional observable, e.g., a speech signal.

One of the profound results established in the theory of nonlinear and chaotic systems and signals is the celebrated Takens' embedding theorem, which states that it is possible to reconstruct a state space that is topologically equivalent to the original state space of a dynamical system from a single observable (Takens, F., "Detecting strange attractors in turbulence", in *Lecture Notes in Mathematics*, Vol. 898, eds. D. A. Rand and L. S. Young, Springer, Berlin, 1981). Chaos theory and nonlinear time-series analysis have attracted a lot of interest in the last two decades (For an overview, see Kantz, H. and Schreiber, T., *Nonlinear Time Series Analysis*, Cambridge University Press, 1998). Methods developed for analyzing nonlinear and chaotic signals and systems represent a radical departure from traditional linear signal-processing techniques. They are generally based on the concepts of state space (or phase space) of a system and time-series embedding. These techniques have already been tried on many types of signals (chaotic and non-chaotic), including human speech.

For example, a book chapter by G. Kubin "Nonlinear Processing of Speech" (in *Speech Coding and Synthesis*, Elsevier, 1995, pp. 557–610) describes some of the attempts to use state-space embedding techniques for speech analysis. The evidence is presented that voiced speech sounds, such as vowels, can be sufficiently embedded in 3-dimensional state space. It is also noted that reconstructed trajectories are periodic for vowels, and that pitch period can be measured in state space by using Poincaré sections (See also I. Mann and S. McLaughlin, "A nonlinear algorithm for epoch marking in speech signals using Poincaré maps", Proceedings of EUSIPCO, vol.2, 1998, pp. 701–704). Yet, a reliable and accurate method for determining the fundamental frequency of a signal from its reconstructed state space has not been introduced to date.

In view of the above discussion, there remains a need for improved methods and apparatus for detecting periodicity and/or for determining the fundamental frequency of a signal, for example, a speech signal.

SUMMARY OF THE INVENTION

The present invention is directed to methods and apparatus for pitch and periodicity determination in speech and/or other signals. It is also directed to methods and apparatus for pitch tracking and/or for detecting voiced or unvoiced portions in speech signals.

In accordance with the present invention, information about pitch and periodicity of a signal is obtained using methods of signal embedding into a multi-dimensional state space, originally introduced in the theory of nonlinear and chaotic signals and systems.

In one embodiment of the invention, speech signal is acquired and pre-processed in a known manner, by performing processing including analog-to-digital conversion. A sampled digitized signal is represented, in a conventional way, as a sequence of frames, each frame including a predetermined number of samples. Each frame is embedded into an m-dimensional state space by using an embedding procedure. In one particular exemplary embodiment, a time-delay embedding procedure is used with a fixed embedding dimension, e.g., of three, and a constant delay parameter equal to a predetermined number of samples. This embedding procedure transforms each frame into a sequence of m-dimensional vectors describing a trajectory in m-dimensional state space.

In accordance with the present invention, closest pairs of vectors are selected from a plurality of possible pairs of vectors in the sequence of m-dimensional vectors. Closest pairs of vectors represent nearest-neighbor points on the reconstructed trajectory and have the smallest distances between vectors in m-dimensional state space. Euclidean distances in m-dimensional space are used in the aforementioned exemplary embodiment, but other distance norms can also be used. In one embodiment, closest pairs of vectors are selected by identifying pairs of vectors with a distance between vectors in state space less than a predetermined, e.g., set, neighborhood radius. Each pair of vectors has a certain time separation between vectors which can be expressed in terms of a number of samples.

A periodicity histogram is obtained by accumulating total numbers of the selected closest pairs of vectors with the same time separations between vectors in corresponding histogram bins. The obtained histogram is characterized by distinct peaks corresponding to a fundamental period and its integer multiples for periodic signals, and by the absence of such peaks for non-periodic signals. Each bin in the periodicity histogram can be normalized with respect to its maximal possible value to obtain a normalized periodicity histogram.

The periodicity histogram generated in accordance with the invention, is a function of a number of selected closest pairs, or equivalently, of a chosen neighborhood radius in state space. In one embodiment, a reconstructed trajectory for each frame is normalized to fit into a unit cube in state space, and a constant predetermined neighborhood radius is used for selecting closest pairs of vectors. In a particularly useful embodiment, an adaptive procedure for selecting an appropriate number of closest pairs is used. The adaptive procedure performs selection of the closest pairs based on the detected magnitude of the highest histogram peak, in order to make main histogram peaks more reliable and easy to identify.

The obtained periodicity histogram is searched for highest peaks in a predetermined interval of possible pitch values. In one embodiment, the position of the highest peak in the periodicity histogram is used as a local estimate of the pitch period in samples. However, in another particularly useful embodiment, a normalized periodicity histogram is used to identify one or more highest peaks, and the positions of the identified peaks are then used as pitch period candidates for further post-processing.

After obtaining a periodicity histogram and identifying highest histogram peaks for each of the successive speech frames, a post-processing technique can be, and in various embodiments is, employed to construct a pitch track and to perform voiced/unvoiced segmentation of a speech signal. Various suitable post-processing methods, e.g. dynamic programming, can be used with the present invention. One feature of the present invention is directed to a simple and efficient method for performing simultaneous pitch tracking and voiced/unvoiced segmentation of speech signals with minimal processing delay.

In accordance with the pitch tracking method of the present invention, speech frames are classified as either "reliable" or "unreliable". A speech frame is classified as reliable, if it has one or more pitch period candidates and, in case of several pitch candidates, they are integer multiples of the lowest candidate's value. Additional conditions can also be imposed to determine if the frame is reliable. Other frames, e.g., all other frames in one embodiment, are classified as unreliable. A start of voicing determination is made when a sequence of several (two in one particular exemplary embodiment) consecutive reliable frames is encountered, provided that their corresponding pitch candidates match each other. After the start of a voiced segment is determined, a pitch-tracking procedure attempts to track pitch period backward and forward in time. The maximal number of frames to track backward may be limited by the maximal allowed processing delay. The pitch-tracking procedure searches a plurality of pitch candidates for the best match to the current pitch estimate, subject to constraints of pitch continuity for consecutive voiced frames. When the pitch track can no longer be continued, an unvoiced decision is made.

In other embodiments of the invention, alternative embedding procedures can be used in place of time-delay embedding. One particular alternative embedding procedure is singular value decomposition embedding, which can be advantageous for noisy signals.

In further embodiments of the invention, a method of forming pairs of vectors for selecting the closest pairs can be modified, in order to have the same maximal value for each histogram bin.

The illustrative embodiments are described in particular relation to speech signals, but the invention has a general nature and can be applied to any signals.

Additional details, features and benefits of the present invention are discussed in the detailed description that follows.

DETAILED DESCRIPTION OF THE INVENTION

Figure 1A:
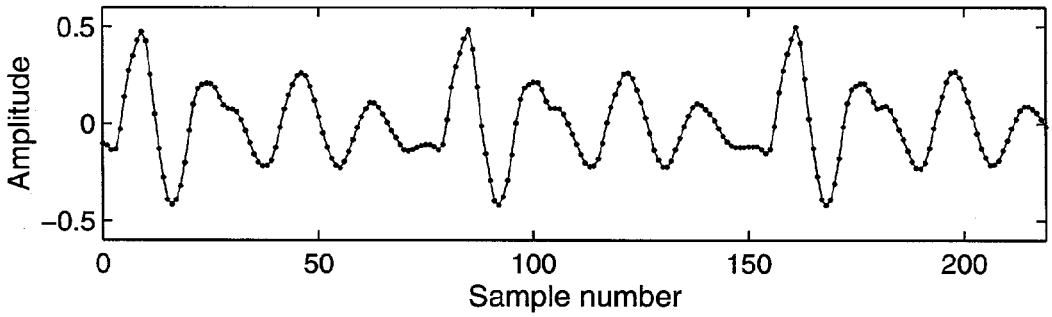
FIG. 1A illustrates a speech frame of 220 samples of speech corresponding to the sustained vowel /AA/.

As discussed above, the theoretical concepts upon which the present invention is based were originally introduced for analyzing nonlinear and chaotic systems and signals. Therefore, the invention is described here using terms like "state space", "embedding" and "reconstructed trajectory", borrowed from the theory of nonlinear and chaotic systems and signals. However, the invention can also be described simply in terms of the basic mathematical operations performed on signal samples, without any reference to abstract theoretical concepts.

In the theory of nonlinear and chaotic systems, the evolution of a dynamical system is described by a point, or vector, moving along some trajectory in an abstract "state space" (also called "phase space" elsewhere), where the coordinates of the point represent independent degrees of freedom of the system. The Takens' embedding theorem states that it is possible to reconstruct a multi-dimensional state space, that is topologically equivalent to an original (unknown) state space of a dynamical system, from a single one-dimensional observable (Takens, F., "Detecting strange attractors in turbulence", in *Lecture Notes in Mathematics*, Vol. 898, eds. D. A. Rand and L. S. Young, Springer, Berlin, 1981). Human speech is generated by a highly complex nonlinear dynamical system, yet the only observable output of this system for most practical purposes is a speech signal. Accordingly, a scalar one-dimensional speech signal can be used to reconstruct a multi-dimensional state space topologically equivalent to the original state space, in which the complex nonlinear dynamics of human speech production take place.

Signal Embedding:

Processing speech or any other signal in accordance with the present invention begins with signal embedding into an m-dimensional state space. This step is normally preceded by a signal pre-processing stage, which may be implemented using known techniques. Pre-processing normally includes analog-to-digital conversion that produces a sampled digitized signal. For example, in one particular embodiment of the invention, a speech signal is sampled at 16 kHz with 16-bit linear-scale accuracy. Some optional signal conditioning can also be applied to a signal in the pre-processing stage.

It should be understood that the method of the present invention can work on raw digitized speech signals and does not explicitly require any signal pre-conditioning. However, in many cases using some conventional signal-conditioning techniques, like moderate low-pass filtering, can improve the quality of results.

To deal with the non-stationary nature of speech signals, a sampled digitized signal is represented, in a usual way, as a sequence of (overlapping) frames. Each frame includes a portion of the sampled digitized signal, or a sequence of successive samples. In one exemplary embodiment, each frame includes a constant number of samples N.

Conventional short-term pitch-determination methods usually require that each frame include at least two complete pitch periods. One of the important advantages of the present invention is that it can produce reliable pitch estimates with frames shorter than two (but longer than one) complete pitch periods in the case of clean periodic signals. The upper limit on a frame size is dictated by a range of possible pitch periods and by resolution requirements. In particular, N should preferably be chosen such that each frame does not include too many pitch periods.

For example, in said particular embodiment each frame includes N=200 samples and successive frames overlap by 100 samples. This value of N can be used for most female voices (with F0 in the range 100–400 Hz, for example), provided that speech signal is clean and sampled at 16 kHz. For other voices and sampling rates the value of N should be chosen appropriately. Variable-sized frames can also be used in other embodiments of the invention.

In accordance with the present invention, a sampled signal in each frame is embedded into m-dimensional state-space by use of an embedding procedure. The embedding procedure used in the exemplary embodiment is time-delay embedding. In such an embodiment, vectors x(i) in m-dimensional state space are formed from time-delayed values of a signal s(i):

$$x(i)=\{s(i), s(i-d), s(i-2d), \ldots s(i-(m-1)d)\} \qquad \text{EQ. 1}$$

where m is the embedding dimension and d is the delay parameter, or lag (in integer number of samples).

Time-delay embedding transforms each frame of N samples s(i) (i=1 . . . N) into a sequence of M vectors x(i) (i=1 . . . M), or points in m-dimensional state space. (The terms "m-dimensional vector" and "point in m-dimensional space" have the same meaning in this description: a set of m independent coordinates uniquely defining location in m-dimensional space). These m-dimensional vectors x(i) correspond to successive points on a reconstructed trajectory in m-dimensional state space, which is topologically equivalent to the original state space of a signal-generating system, e.g., a nonlinear speech generation process.

The resulting sequence of vectors x(i) (i=1 . . . M) can be represented in the form of a trajectory matrix X:

$$X = \begin{matrix} \{x(1)\} \\ \{x(2)\} \\ \{\ \ldots\ \} \\ \{x(M)\} \end{matrix} = \begin{matrix} \{s(1) & s(1+d) & \ldots & s(1+(m-1)d)\} \\ \{s(2) & s(2+d) & \ldots & s(2+(m-1)d)\} \\ \{\ldots & \ldots & \ldots & \ldots \quad \} \\ \{s(N-(m-1)d) & s(N-(m-2)d) & \ldots & s(N) \quad \} \end{matrix} \qquad \text{EQ. 2}$$

Matrix X has m columns and M=N−(m−1)d rows. The rows contain m-dimensional vectors x(i) describing the trajectory in m-dimensional state space reconstructed using time-delay embedding.

Figure 1B:
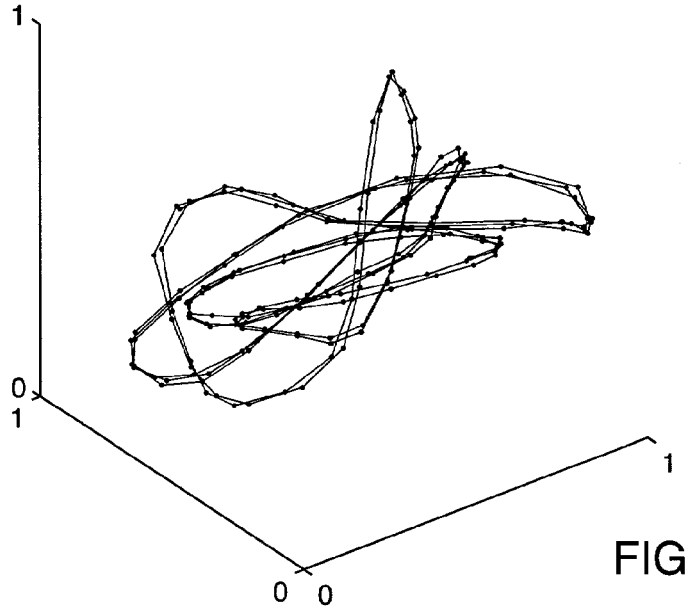
FIG. 1B illustrates time-delay embedding in 3-dimensional state space of the speech frame illustrated in FIG. 1A.
Figure 4A:
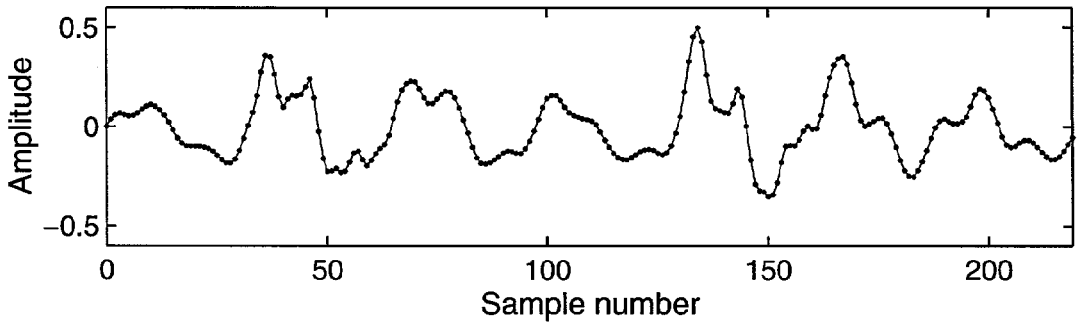
FIG. 4A illustrates a speech frame of 220 samples of the transitional voiced segment of speech.
Figure 4B:
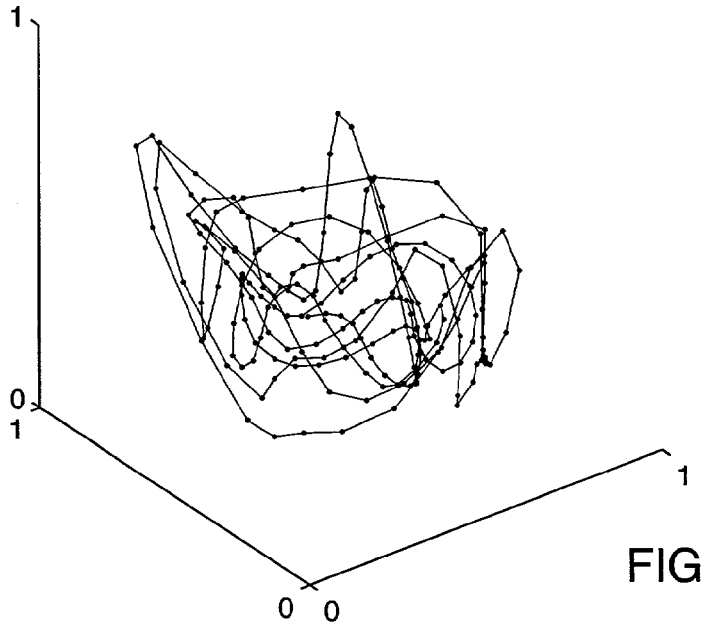
FIG. 4B illustrates time-delay embedding in 3-dimensional state space of the speech frame illustrated in FIG. 4A.
Figure 7A:
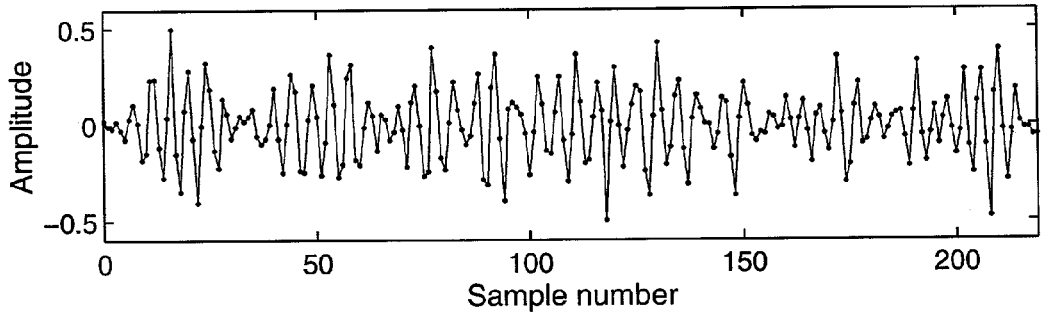
FIG. 7A illustrates a speech frame of 220 samples of the fricative /S/.
Figure 7B:
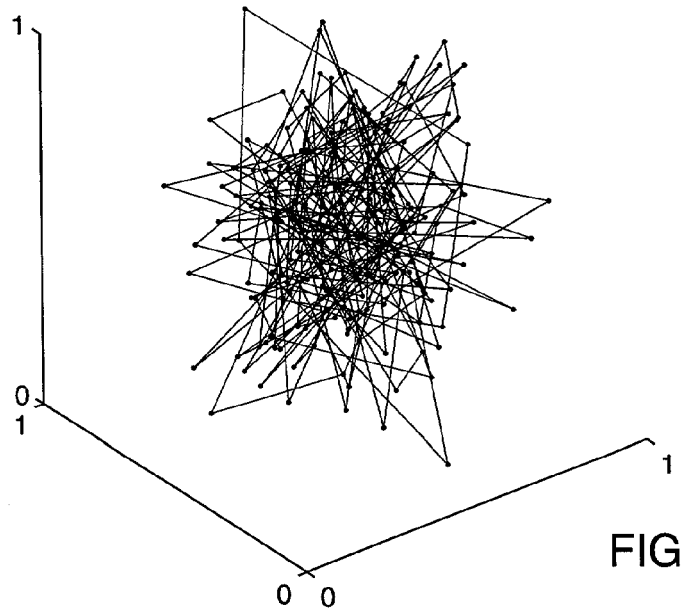
FIG. 7B illustrates time-delay embedding in 3-dimensional state space of the speech frame illustrated in FIG. 7A.

For example, FIGS. 1A, 4A and 7A show frames of N=220 samples of digitized speech signals for a sustained vowel /AA/, a transitional voiced segment and an unvoiced fricative /S/, respectively. FIGS. 1B, 4B and 7B show corresponding 3-dimensional trajectories, reconstructed using time-delay embedding with m=3 and d=10. The trajectories shown in these figures are additionally normalized to fit into the unit cube in state space. In each case, the total number M of points (vectors) on the trajectory is 200 (M=N−(m−1)d).

The reconstructed trajectory for a steady periodic signal, such as sustained vowel in FIG. 1A, has a clear periodic nature. Note that the trajectory in FIG. 1B almost repeats itself after a complete pitch period. This periodicity is less evident in the state-space reconstruction of the transitional voiced segment, such as the one shown in FIG. 4B. For the unvoiced aperiodic fricative, the reconstructed vectors tend to randomly fill the state space, as illustrated in FIG. 7B.

In most cases, voiced speech sounds can be sufficiently embedded in 3-dimensional state space, whereas unvoiced speech sounds (e.g. fricatives) have a high-dimensional nature. Sufficient embedding means, in particular, that a reconstructed trajectory in state space has no self-intersections. Determination of the true embedding dimension is an important problem in chaotic time-series analysis. For the present invention, however, exact knowledge of the embedding dimension is not needed, due to a short-term and statistical nature of the method. In the particular embodiment discussed herein, embedding dimension m=3 is used. It was found experimentally that in many cases good results can be achieved even with m=2, despite the fact that a reconstructed trajectory can have self-intersections. Embedding dimensions can be further increased, but beyond m=3 or m=4, no noticeable improvement has been observed for all practical purposes. Accordingly, the present invention may be used with different values of m. However, in the particular embodiment a constant embedding dimension of three is used to embed successive speech frames.

The optimal value of the delay parameter d in an integer number of samples depends on the sampling rate and on signal properties. The delay parameter should be large enough for a reconstructed trajectory of each frame to be sufficiently "open" in state space. On the other hand, it is desirable to keep the delay parameter relatively small for better resolution.

In the exemplary embodiment, a constant delay parameter d is used for embedding all frames. In the particular embodiment d=10 samples where a sampling rate of 16 kHz is used. In other embodiments, delay parameter d may be chosen differently or even determined independently for each speech frame, in order to adapt to signal properties.

It should be noted that the actual mode of implementing time-delay embedding in accordance with EQ. 1 can differ in various embodiments of the invention. In the exemplary embodiment, a sampled digitized signal is segmented into short (overlapping) frames of N samples each, as discussed above, and each frame is independently embedded according to EQ. 2. In other embodiments it can be advantageous to perform signal embedding continuously by transforming a sampled input signal into a multi-channel signal, where each channel can represent an independent dimension. With time-delay embedding, an m-channel signal can be formed by taking a sampled input signal and its delayed versions (by d, 2d and so on samples) as independent channels. Applying segmentation, or windowing procedure, to this m-channel signal is equivalent to extracting a finite sequence of m-dimensional vectors x(i) (i=1 . . . M) describing a portion of the reconstructed trajectory in state space.

Selecting Closest Pairs of Vectors in State Space:

The sequence of m-dimensional vectors x(i) (i=1 . . . M), obtained after embedding a frame of N samples s(i) (i=1 . . . N), describes the reconstructed trajectory in m-dimensional state space. Each pair of vectors {x(i), x(j)} in the sequence (two points on the trajectory) is separated in m-dimensional state space by some spatial distance D[x(i),x(j)], and in time by some temporal separation Δt=|i−j| (in integer number of samples).

Euclidean distance norm in m-dimensional space may be used as a spatial distance:

$$D[x(i), x(j)] = \left(\sum_{l=1}^{l=m} (x_l(i) - x_l(j))^2\right)^{\frac{1}{2}}$$

The squared Euclidean distances are used to reduce computations when computing and comparing distances in the exemplary embodiment. The use of squared distances avoids the need to perform square root computations.

Distance norms in m-dimensional space other than Euclidean can, and in some embodiments are, used in alternative embodiments of the invention.

For example, one-norm is used in one alternative embodiment:

$$D[x(i), x(j)] = \sum_{l=1}^{l=m} |x_l(i) - x_l(j)|$$

Another possible distance norm in state space is max-norm:

$$D[x(i),x(j)]=\max_l |x_l(i)-x_l(j)|$$

To analyze distances between vectors in m-dimensional state space, distances can be measured relative to the maximal size of the reconstructed trajectory in state space. Alternatively, one can normalize the reconstructed trajectory by applying a linear transformation to each dimension and resulting in measured distances being in normalized units.

In the exemplary embodiment, a reconstructed trajectory for each frame is normalized to fit into the unit cube in m-dimensional state space. This normalization can be achieved by linear scaling and shifting of each dimension, so that each dimension of the trajectory is between 0 and 1.

Since each dimension of the trajectory, reconstructed using time-delay embedding, is a delayed version of the same signal, similar normalization can be achieved by normalizing a sequence of samples in each individual frame prior to time-delay embedding. Thus, in the exemplary embodiment, each signal frame of N samples s(i) (i=1 . . . N) is normalized prior to its time-delay embedding, so that sample values are in the range of 0 to 1:

$$s0 = \min s(i),\ s1 = \max s(i),\ s(i) = \frac{s(i) - s0}{s1 - s0} \qquad \text{EQ. 3}$$

(If s0=s1 then the signal is constant and no further steps are performed for that frame).

A useful graphical tool for visualizing a distribution of spatial distances and time separations between vectors on the reconstructed trajectory is a space-time separation plot, originally introduced by Provenzale, A. et al. for qualitative analysis of chaotic time-series ("Distinguishing between low-dimensional dynamics and randomness in measured time series", Physica D 58, 1992, pp. 31–49). It is a simple scatter plot of spatial distance D[x(i),x(j)] versus time separation |i−j| for each possible pair of vectors {x(i), x(j)} on the trajectory. It should be understood that a space-time separation plot is not needed to practice the invention. Rather, it is used to provide a graphical illustration of basic concepts.

Figure 2A:
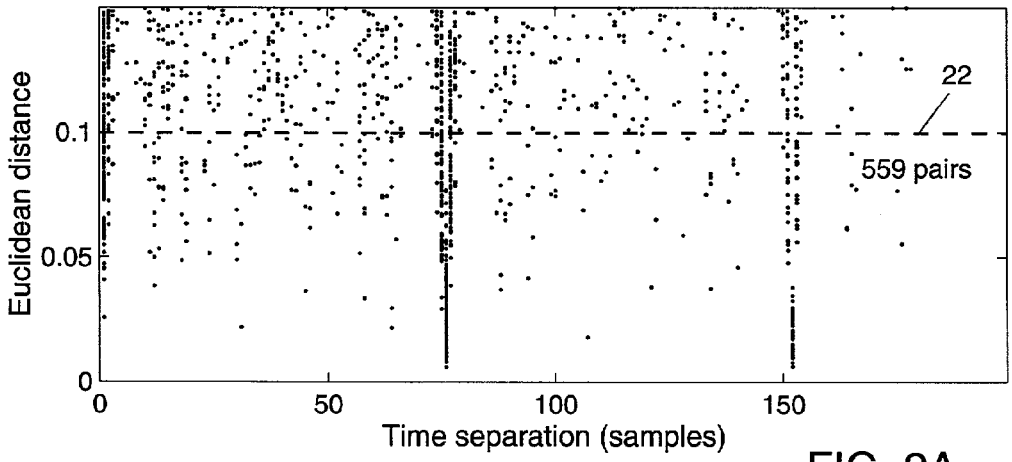
FIG. 2A illustrates a space-time separation plot for the embedded speech frame illustrated in FIG. 1B.
Figure 5A:
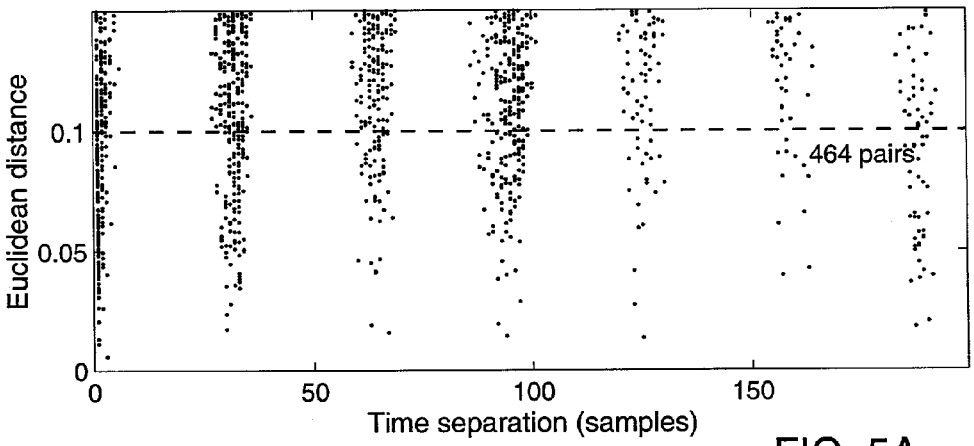
FIG. 5A illustrates a space-time separation plot for the embedded speech frame illustrated in FIG. 4B.
Figure 8A:
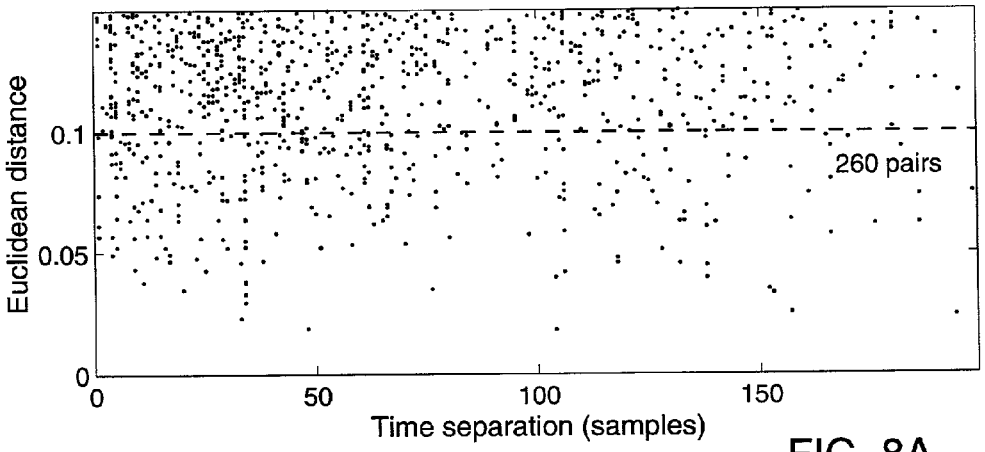
FIG. 8A illustrates a space-time separation plot for the embedded speech frame illustrated in FIG. 7B.

For example, FIGS. 2A, 5A and 8A show space-time separation plots for the reconstructed trajectories of a sustained vowel /AA/, a transitional voiced segment and a fricative /S/, each of which is illustrated in FIGS. 1B, 4B and 7B, respectively. Only the lower parts of the entire plots are actually shown. One can see from FIG. 2A that, in the case of a periodic vowel, data points with small spatial distances tend to concentrate around time separation values corresponding to a fundamental pitch period and its integer multiples. For a transitional voiced segment, some vertical regions of data point concentration are also clearly visible in FIG. 5A. For the unvoiced fricative /S/, data points in the space-time separation plot are randomly distributed along a time separation axis, as it is evidenced by FIG. 8A.

In order to determine pitch in accordance with the present invention, one needs to find closest pairs of vectors on the reconstructed trajectory in m-dimensional state space. Closest pairs of vectors (also known as nearest-neighbor points in state space) are pairs of vectors {x(i), x(j)} with the smallest spatial distances D[x(i),x(j)] between vectors among possible pairs of vectors in the sequence of m-dimensional vectors x(i) (i=1 . . . M).

Closest pairs of vectors can be selected by choosing some neighborhood radius r in state space and identifying pairs of vectors with a distance between vectors in state space less than this radius. This procedure can be illustrated by dissecting a space-time separation plot with a horizontal line at the vertical position corresponding to a chosen r, and selecting all data points below this line. For example, horizontal dashed line 22 in FIG. 2A defines the neighborhood radius r=0.1. In FIG. 2A, there are 559 data points below the line, corresponding to the selected closest pairs of vectors in m-dimensional state space.

In one embodiment, distances D[x(i),x(j)] are computed for all possible non-repeating pairs of vectors in the sequence of m-dimensional vectors: {x(i), x(j)}, where i, j=1 . . . M and i<j. The computed distances are then compared with the predetermined value of r, and pairs with a distance D[x(i),x(j)]<r are selected as closest pairs. In the exemplary embodiment, squared Euclidean distances are computed. The computed distances are compared with the squared value of r. The value of r should be chosen appropriately. For example, in one embodiment reconstructed trajectories for all frames are normalized to fit into a unit cube in state space and a constant radius r=0.15 is used.

One can also select a predetermined number of vector pairs with the smallest distances between vectors in state space from a set of vector pairs. Thus, in one embodiment closest pairs of vectors are selected by computing spatial distances D[x(i),x(j)] for all possible non-repeating pairs of vectors in the sequence of vectors x(i) (i=1 . . . M), ordering vector pairs by their spatial distances in increasing order, and selecting a predetermined number n of closest pairs from the ordered set of vector pairs. The selection can be easily performed as a result of the ordering.

For the selected closest pairs of vectors {x(i),x(j)}, the corresponding time separations between vectors $\Delta t=|i-j|$ (in integer number of samples) are retained for computing a periodicity histogram.

Periodicity Histogram:

A periodicity histogram is computed based on time separation values of the selected closest pairs of vectors. Each bin in the periodicity histogram accumulates a total number of selected closest pairs having the same time separation between vectors, e.g., as expressed by the number of samples corresponding to a bin index. The term "histogram" in this description is used to refer to a one-dimensional array of numbers, where each bin in a histogram corresponds to an element of the one-dimensional array.

Periodicity histogram computation can be performed by summing up data points with the same horizontal positions (that is, lined up vertically) and located below line 22 in the space-time separation plot of FIG. 2A, to yield the histogram shown in FIG. 2B.

For the sequence of vectors x(i) (i=1 . . . M) representing a trajectory in m-dimensional state space, a periodicity histogram can be formally defined as $$hist(k) = \sum_{i=1}^{i=M-k} H(r - D[x(i), x(i+k)]) \qquad \text{EQ. 4}$$

where k is a bin index corresponding to the time separation in samples between vectors x(i) and x(i+k), r is a predetermined neighborhood radius, D[x(i),x(i+k)] is a spatial distance between vectors and H is Heaviside function.

As discussed above, Euclidean spatial distance between vectors, used in the exemplary embodiment, can be replaced with some other distance norm in m-dimensional space.

Figure 2B:
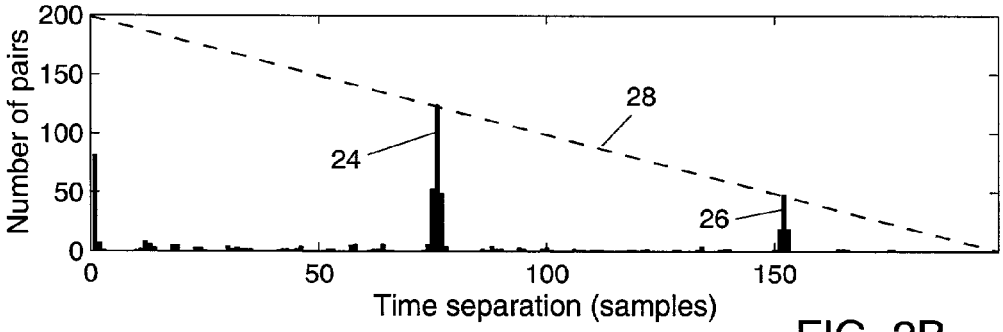
FIG. 2B illustrates a periodicity histogram computed with the neighborhood radius r=0.1 for the embedded speech frame illustrated in FIG. 1B.
Figure 5B:
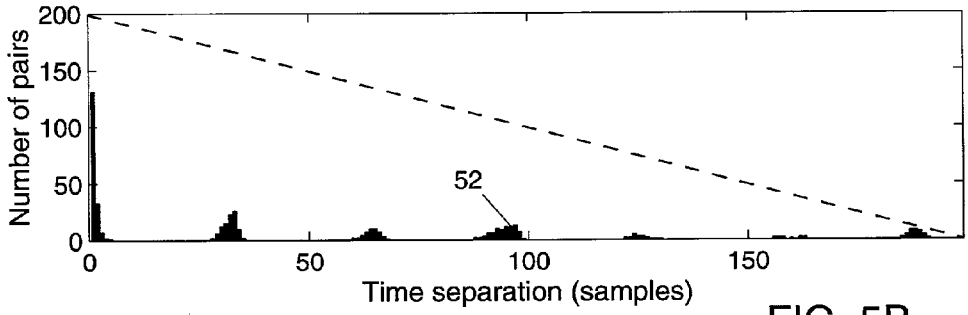
FIG. 5B illustrates a periodicity histogram computed with the neighborhood radius r=0.1 for the embedded speech frame illustrated in FIG. 4B.
Figure 8B:
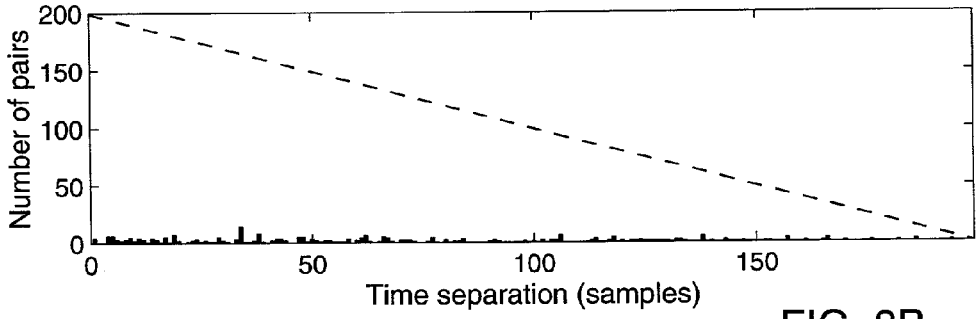
FIG. 8B illustrates a periodicity histogram computed with the neighborhood radius r=0.1 for the embedded speech frame illustrated in FIG. 7B.

FIGS. 2B, 5B and 8B show periodicity histograms computed according to EQ. 4 with r=0.1 for a sustained vowel /AA/, a transitional voiced segment and an unvoiced fricative /S/, respectively. FIG. 2B shows a sharp peak 24 corresponding to the fundamental pitch period of a periodic vowel, and a second sharp peak 26 corresponding to twice the pitch period value. The periodicity histogram in FIG. 5B, computed for the transitional voiced segment, shows a peak 52 corresponding to a fundamental pitch period. However, in this case the peak 52 is much lower and is not sharp. The periodicity histogram for the unvoiced fricative /S/ in FIG. 8B shows many random low peaks distributed along the time separation axis.

In general, a periodicity histogram, computed according to EQ. 4 with an appropriately chosen value of r (or equivalently, with an appropriate number of selected closest pairs of vectors), will have distinct peaks corresponding to a fundamental period and its integer multiples for periodic signals. Periodicity histograms corresponding to aperiodic signals will lack such characteristic peaks.

Histogram bins with small index values of k near or equal to zero should be excluded from consideration when searching for histogram peaks. These bins correspond to pairs of vectors with small time separations between vectors in samples. Such pairs of vectors represent successive points on the reconstructed trajectory and, therefore, are normally close in state space. In particular, the highest histogram peak according to EQ. 4 is always at k=0 and its magnitude is equal to M.

Since the summation interval in EQ. 4 linearly shrinks with an increasing value of k, a periodicity histogram has a bias: an upper bound is not the same for all bins and is a linearly decaying function of k, as shown by slanting line 28 in FIG. 2B. This causes the magnitudes of histogram peaks to decay with increasing values of k, as it is observed in FIG. 2B. Due to this decay, the main histogram peak, corresponding to the lowest sub-multiple and representing a true fundamental period, is usually the largest of all peaks for clean and steady periodic signals, as it is evidenced by peak 24 in FIG. 2B. Thus, locating the highest peak in the periodicity histogram can give a reliable pitch period estimate for clean and steady periodic frames.

For larger values of k approaching M only a few numbers can be accumulated when computing corresponding histogram bins. Hence, histogram bins close to the right edge are statistically unreliable and should also be excluded from consideration when searching for peaks.

In the exemplary embodiment, a periodicity histogram is computed and searched for peaks for the values of k in the predetermined interval of possible pitch periods and not for other values of k. Thus, in such an embodiment, only pairs of vectors with time separation values k satisfying plow<k<phigh need to be considered when selecting the closest pairs, where plow and phigh are low and high bounds defining a pitch search interval. Such an embodiment avoids computing unused bin values. However, the invention does not preclude such computations.

For example, in the particular embodiment plow=40 and phigh=160, when the other parameters are chosen as follows: N=200 samples, m=3, d=10 and the speech signal is sampled at 16 kHz.

Figure 10:
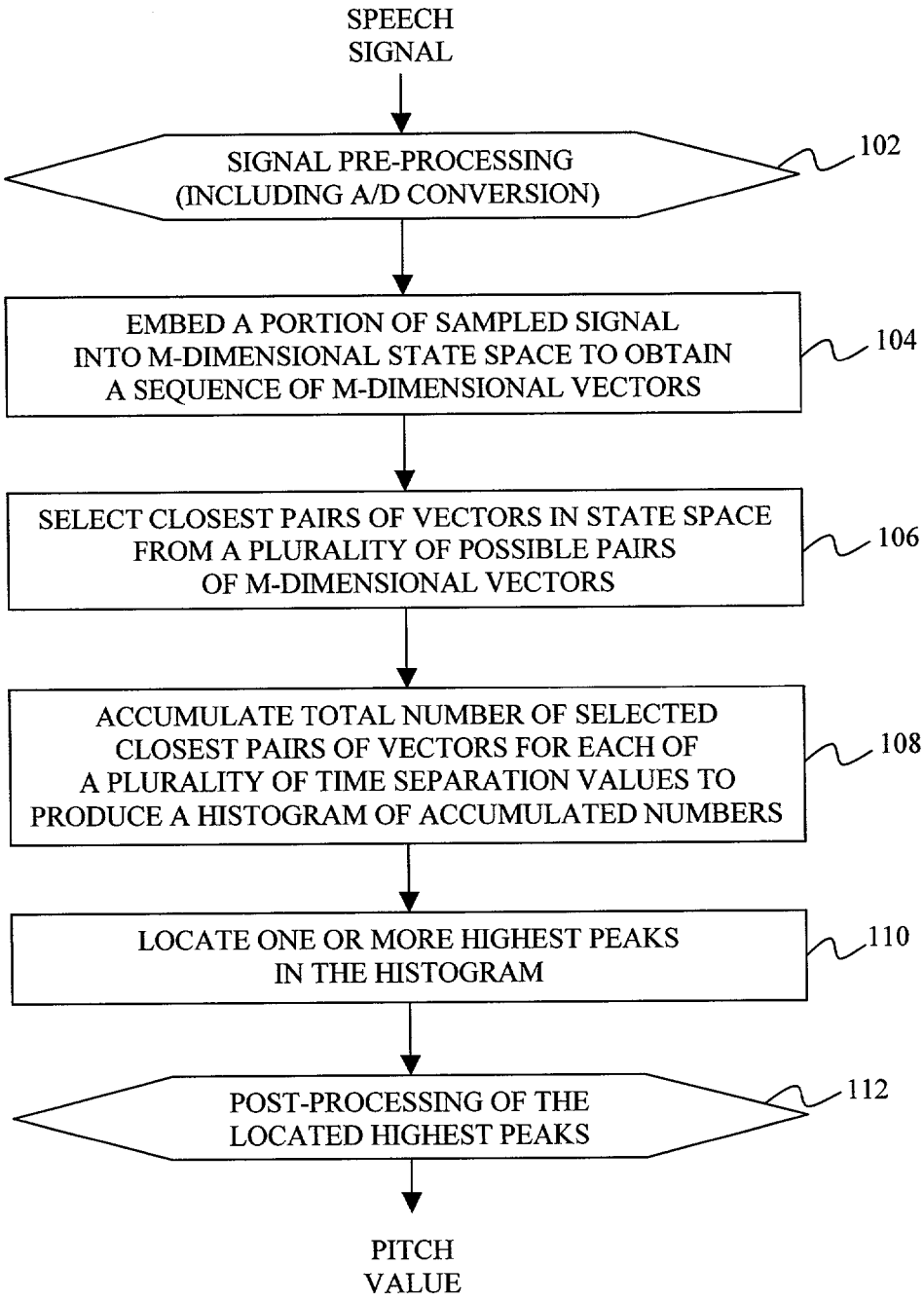
FIG. 10 is a flowchart illustrating the basic steps involved in determining pitch in accordance with the present invention.

The basic steps involved in determining pitch in accordance with the method of the present invention are summarized in the flowchart of FIG. 10. A speech signal is converted into a sampled digitized format in pre-processing step 102. A portion of the sampled signal (speech frame in the exemplary embodiment) is then embedded into an m-dimensional state space in step 104 to obtain a sequence of m-dimensional vectors. A plurality of possible pairs of vectors in the sequence of m-dimensional vectors are considered, and the closest pairs of vectors in state space are selected in step 106. In one embodiment, closest pairs of vectors are selected by identifying pairs of vectors with a distance between vectors in state space less than a predetermined neighborhood radius r (For example, r=0.15, provided that the reconstructed trajectory is normalized to fit into a unit cube in state space). A periodicity histogram is then computed in step 108 by accumulating the total number of selected closest pairs for each of the different time separation values. Then, the computed histogram is searched for highest peaks in step 110 to obtain information about pitch and periodicity. In one embodiment, the highest peak in a predetermined histogram interval is identified and its position is used to provide a pitch period estimate. More than one histogram peak can be identified and retained for use in optional subsequent post-processing step 112, which can analyze more than one consecutive frame.

Normalized Periodicity Histogram:

In order to prevent a decay of peak magnitudes in a periodicity histogram with increasing bin index k, each bin can be normalized with respect to its upper bound to produce a normalized periodicity histogram. This upper bound for each bin index k is equal to the total number of vector pairs with time separation of k samples in a set of all considered pairs of vectors.

For the sequence of m-dimensional vectors x(i) (i=1 . . . M) in state space a normalized periodicity histogram can be formally defined as $$nhist(k) = \frac{1}{(M-k)} \sum_{i=1}^{i=M-k} H(r - D[x(i), x(i+k)]) \qquad \text{EQ. 5}$$

The difference between EQ. 5 and EQ. 4 is that the accumulated number in EQ. 5 for each value of k is divided by the total number of pairs (M−k), so that the value of each bin cannot exceed 1. If the value of r in EQ. 5 is chosen sufficiently large, then nhist(k)=1 for all values of k.

Figure 2C:
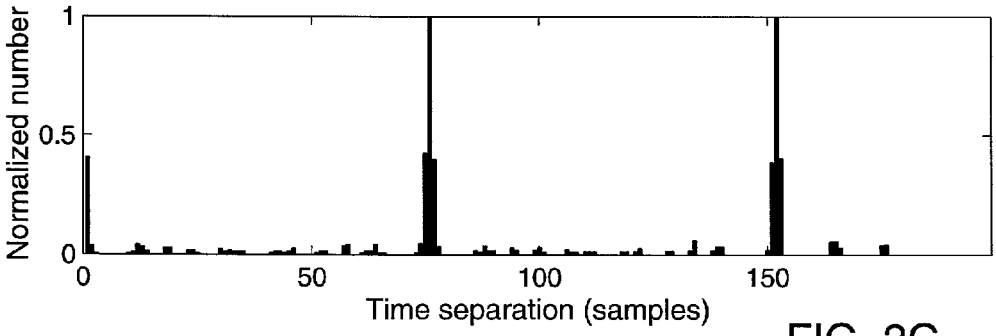
FIG. 2C illustrates a normalized periodicity histogram obtained from the histogram illustrated in FIG. 2B.
Figure 5C:
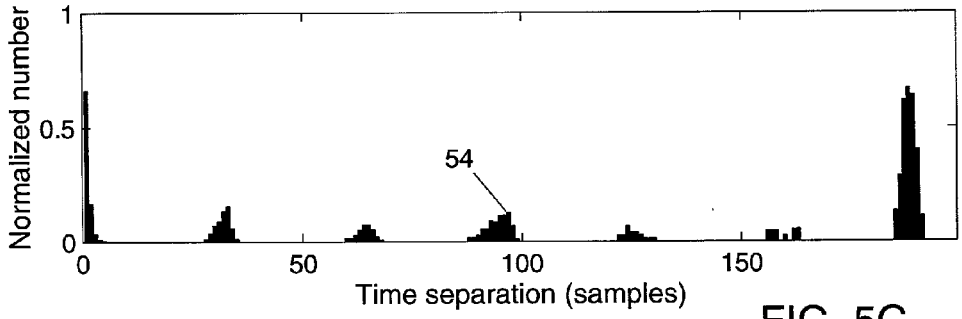
FIG. 5C illustrates a normalized periodicity histogram obtained from the histogram illustrated in FIG. 5B.
Figure 8C:
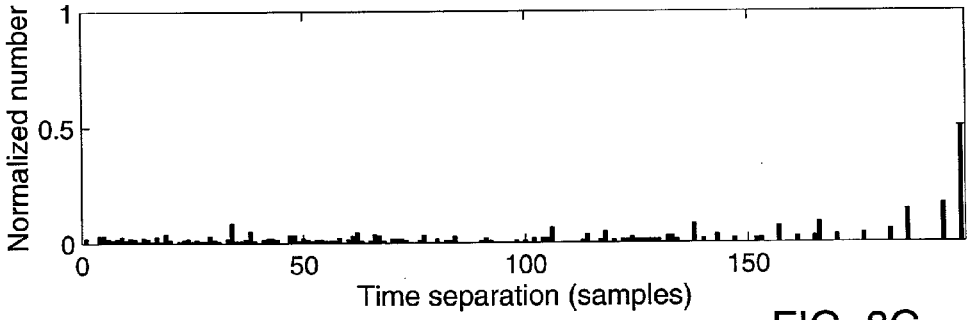
FIG. 8C illustrates a normalized periodicity histogram obtained from the histogram illustrated in FIG. 8B.

Normalized periodicity histograms, obtained by normalizing the histograms of FIGS. 2B, 5B and 8B, are shown in FIGS. 2C, 5C and 8C, respectively.

A normalized periodicity histogram defined by EQ. 5 has a large variance at larger bin indices k approaching M due to a small number of data values involved in computing these bins. Thus, similar to the periodicity histogram of EQ. 4, the upper bound phigh of the peak-searching interval in the normalized periodicity histogram of EQ. 5 should be chosen appropriately.

Selecting an Appropriate Number of Closest Pairs of Vectors:

A periodicity histogram, computed according to EQ. 4 or EQ. 5, is a function of a neighborhood radius r in state space, or equivalently, of a number of selected closest pairs of vectors. The peaks in the periodicity histogram are directly affected by the value of r, or by the number of selected closest pairs of vectors in state space.

A space-time separation plot provides a graphical illustration of this concept: moving horizontal line 22 in FIG. 2A up or down reflects increasing or decreasing neighborhood radius, and results in more or less data points (vector pairs) located below the line and selected for computing a periodicity histogram.

Figure 3A:
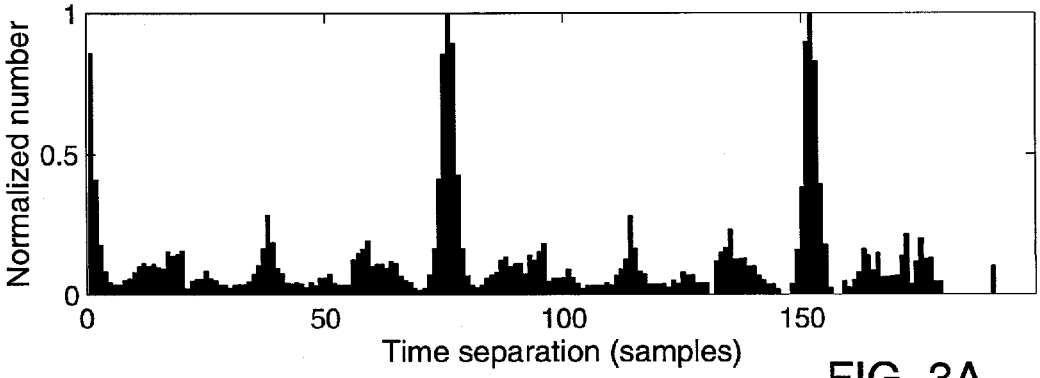
FIG. 3A illustrates a normalized periodicity histogram computed with r=0.2 for the embedded speech frame illustrated in FIG. 1B.
Figure 3B:
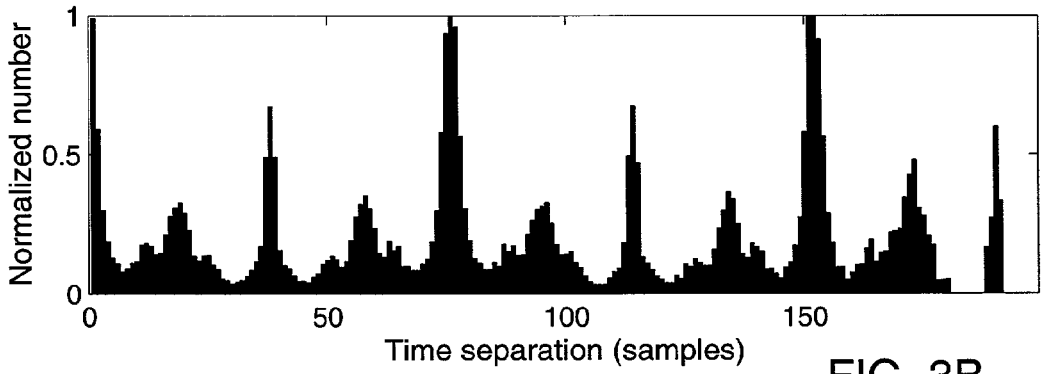
FIG. 3B illustrates a normalized periodicity histogram computed with r=0.25 for the embedded speech frame illustrated in FIG. 1B.
Figure 6A:
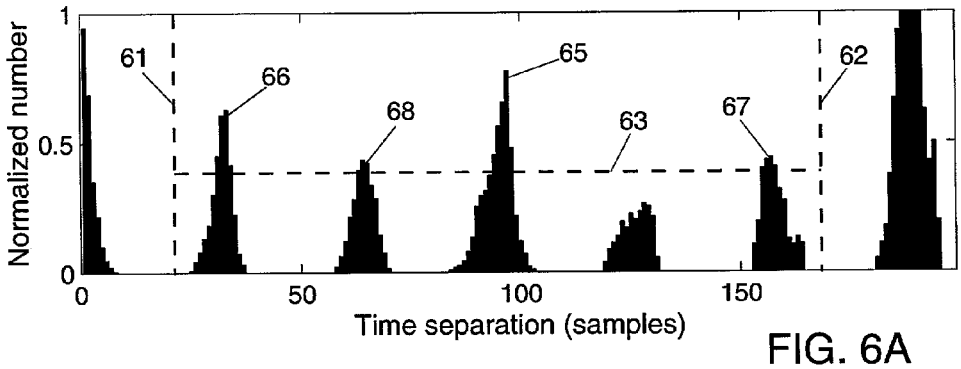
FIG. 6A illustrates a normalized periodicity histogram computed with r=0.2 for the embedded speech frame illustrated in FIG. 4B.
Figure 6B:
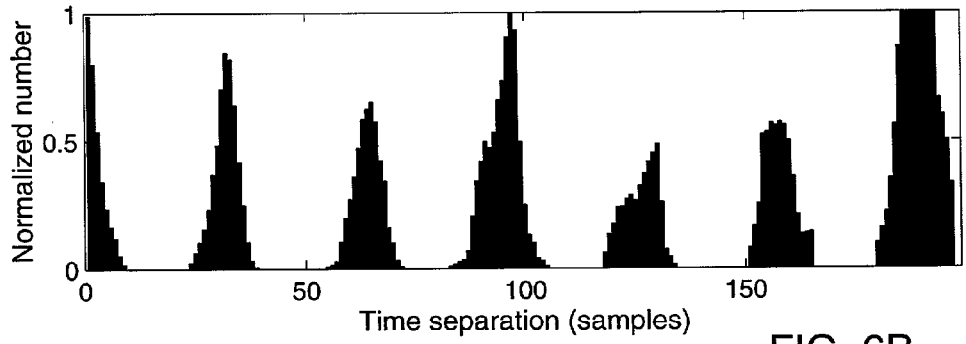
FIG. 6B illustrates a normalized periodicity histogram computed with r=0.25 for the embedded speech frame illustrated in FIG. 4B.
Figure 9A:
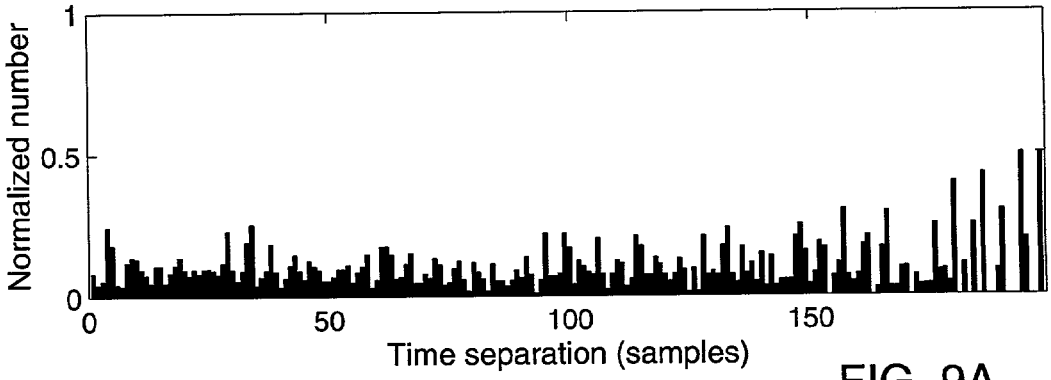
FIG. 9A illustrates a normalized periodicity histogram computed with r=0.2 for the embedded speech frame illustrated in FIG. 7B.
Figure 9B:
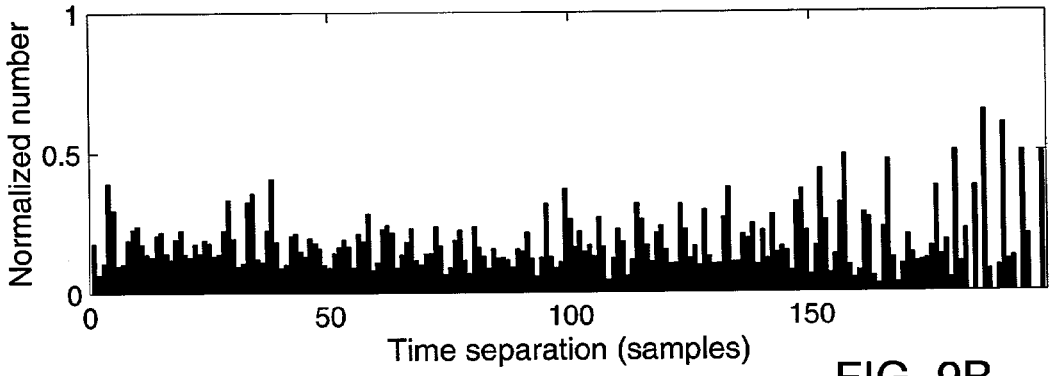
FIG. 9B illustrates a normalized periodicity histogram computed with r=0.25 for the embedded speech frame illustrated in FIG. 7B.

For example, FIGS. 3A, 6A and 9A show normalized periodicity histograms, computed according to EQ. 5 with r=0.2, for speech frames of a sustained vowel /AA/, a transitional voiced segment and a fricative /S/, respectively. FIGS. 3B, 6B and 9B show otherwise similar histograms computed with a larger neighborhood radius, r=0.25. FIGS. 2C, 5C and 8C show similar normalized histograms computed with the smaller radius r=0.1. In all cases, reconstructed trajectories are normalized to fit into the unit cube in state space, as discussed above.

Figure 3C:
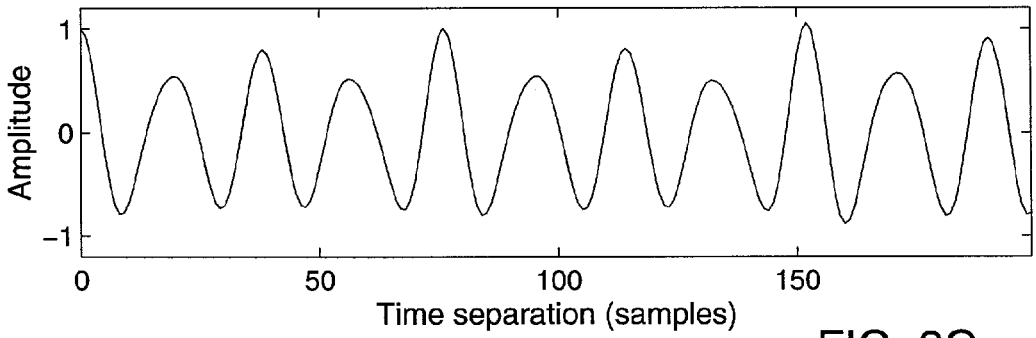
FIG. 3C illustrates an unbiased auto-correlation function computed for the speech frame illustrated in FIG. 1A.
Figure 6C:
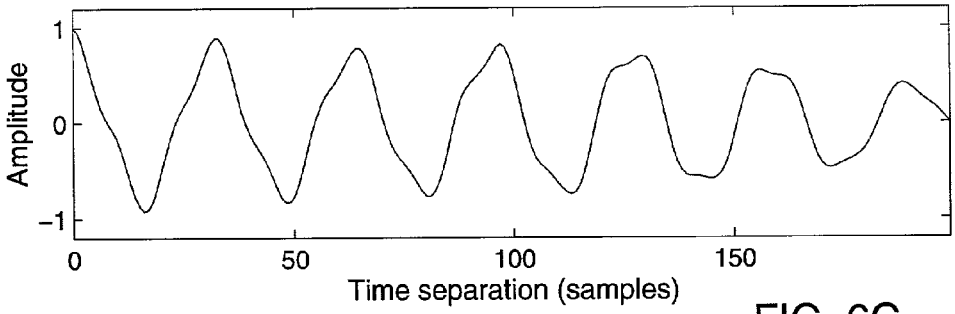
FIG. 6C illustrates an unbiased auto-correlation function computed for the speech frame illustrated in FIG. 4A.
Figure 9C:
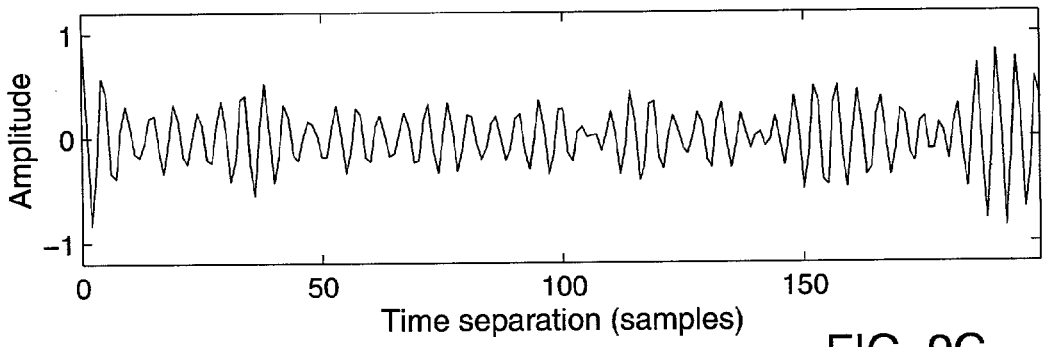
FIG. 9C illustrates an unbiased auto-correlation function computed for the speech frame illustrated in FIG. 7A.

For comparison purposes, FIGS. 3C, 6C and 9C show unbiased auto-correlation functions, computed for the same speech frames of the sustained vowel /AA/, the transitional voiced segment and the fricative /S/, respectively.

For clean and steady periodic signals, like the vowel in FIG. 1A, main histogram peaks, corresponding to a fundamental period and its integer multiples, tend to quickly saturate at the upper bound as the value of r is increased. For example, FIG. 2C shows that peaks corresponding to the fundamental pitch period of the sustained vowel and its doubled value are already saturated at one with r=0.1. Further increasing the neighborhood radius r eventually leads to the widening of the main peaks and, in many cases, to the emergence and growth of secondary peaks, as illustrated in FIGS. 3A and 3B, for example. It is interesting to note that secondary peaks in the periodicity histogram correspond to the secondary peaks in the correlation function, as one can observe from comparison of FIG. 3B and FIG. 3C. Consequently, one can say with reasonable certainty that secondary histogram peaks, which can emerge at larger values of r, are attributed to speech formants, or vocal tract resonances.

For transitional signal segments with less than perfect periodicity, main histogram peaks tend to grow at a slower rate with increasing neighborhood radius r, and to saturate with larger values of r. For example, peak 54 in the normalized histogram of FIG. 5C, computed with r=0.1, is rather low, statistically not very reliable, and can be problematic to identify and to accurately locate its position. The corresponding peak 65 in the histogram of FIG. 6A, computed with the increased neighborhood radius r=0.2, becomes larger, more reliable, is easy to identify and in addition, it is easy to locate the main peak's exact position precisely. This peak 65 eventually saturates at one in the histogram of FIG. 6B, computed with r=0.25.

For unvoiced aperiodic fricatives, random peaks in the normalized histogram remain low until the value of r is increased substantially, as illustrated in FIGS. 8C, 9A and 9B. Eventually, all bins in the normalized periodicity histogram saturate at one, as the value of r becomes sufficiently large, in accordance with EQ. 5. Large histogram peaks close to the right edge in FIGS. 5C and 8C are attributed to a large variance in the normalized histogram due to a small number of data values involved in computing corresponding bins, as discussed above.

From the above description it follows that, in order to practice the invention, it can be important to choose and/or use an appropriate neighborhood radius r in state space, or equivalently, an appropriate number of closest pairs of vectors for computing the periodicity histogram.

In one embodiment of the invention, reconstructed trajectories for all frames are normalized to fit into the unit cube in state space, and a constant value of r is used to compute a periodicity histogram for each frame. The constant value of r is chosen to provide optimal results on average for different types of speech frames. For example, r=0.15 in one embodiment.

However, it is also evident from the above description that the optimal value of r is different for different types of signal frames. In particular, it is desirable to keep the radius r relatively small for clean and steady periodic frames, whereas r should be significantly increased for frames with less than perfect periodicity of a signal. Therefore, it is advantageous to determine the neighborhood radius r, or the number of the selected closest pairs of vectors, independently for each signal frame.

In the exemplary embodiment of the invention, an adaptive method of selecting closest pairs of vectors is used to obtain a final periodicity histogram for locating highest peaks. The adaptive method, which is illustrated by the flowchart in FIG. 11, can adjust a number of the selected closest pairs based on the magnitude of the highest peak in the normalized periodicity histogram. In particular, the method tries to bring the highest peak's magnitude to a predetermined range of values, subject to certain constraints. Since the highest peak's magnitude is not known before the histogram is computed, the method has an iterative nature: the histogram can be recomputed several times with different numbers of selected closest pairs, each time checking the highest peak's magnitude and other conditions and adjusting the number of the selected closest pairs appropriately.

Figure 11:
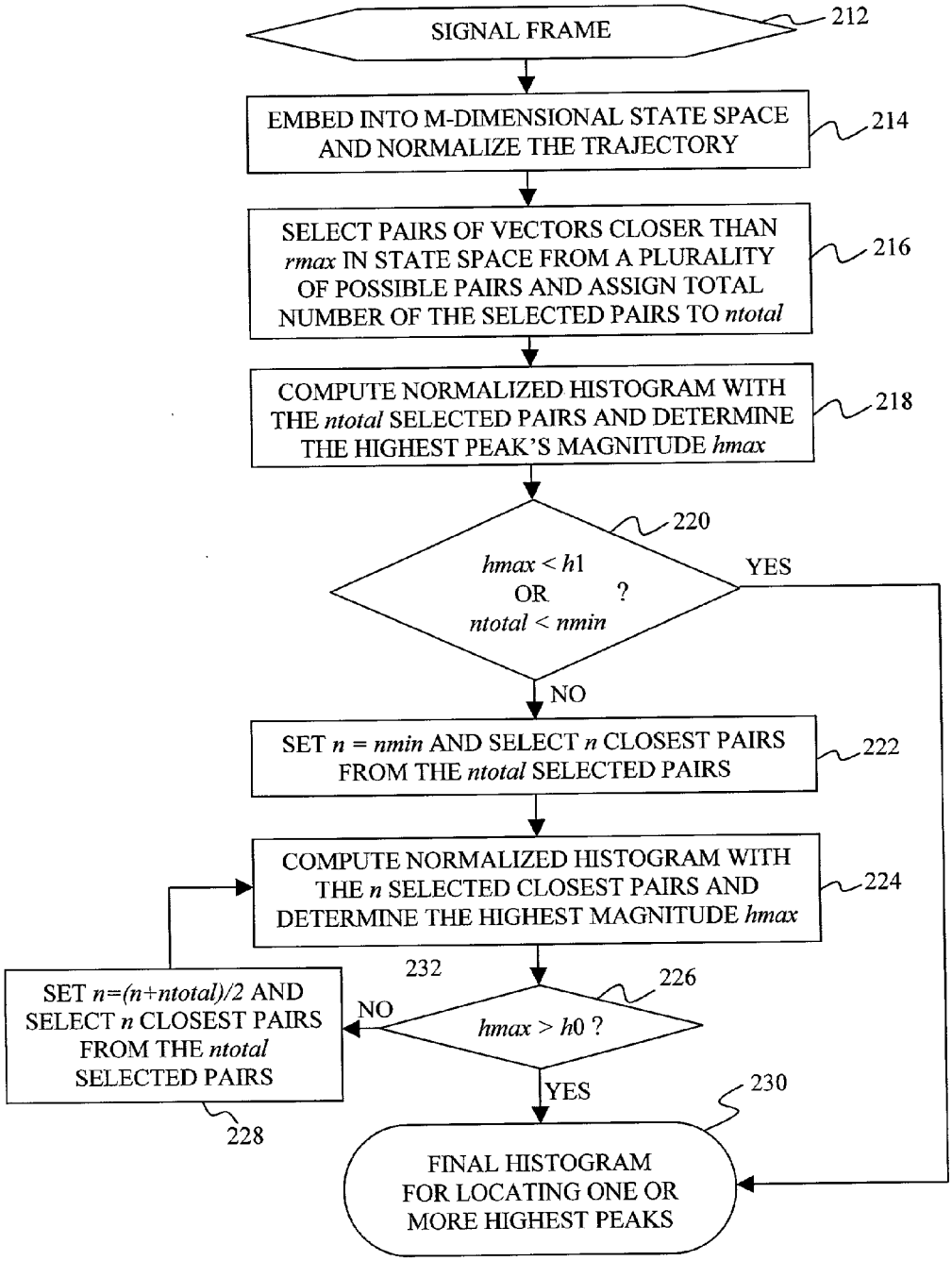
FIG. 11 is a flowchart illustrating an adaptive method of selecting closest pairs of vectors for a periodicity histogram in accordance with one embodiment of the invention.

The adaptive method of FIG. 11 performs the following steps for each signal frame of N samples: frame 212 is embedded into an m-dimensional state space in step 214, and the resulting trajectory, described by the sequence of m-dimensional vectors, is normalized to fit into the unit cube in state space. Then, pairs of vectors closer than rmax in state space are selected from a set of possible vector pairs in the sequence of m-dimensional vectors in step 216. The set of possible vector pairs includes all possible pairs of vectors with time separations between vectors in the valid search interval plow<k<phigh. The constant value rmax defines a maximal allowed neighborhood radius in state space, for example, r=0.2. All of the selected pairs closer than rmax are retained for further processing, and their total number is assigned to ntotal. A normalized periodicity histogram is computed with the ntotal selected pairs in step 218, and the magnitude hmax of the highest histogram peak is determined (in the valid interval plow<k<phigh).

The highest peak's magnitude hmax is compared to the constant value h1 in step 220, in order to determine if the highest peak is saturated at one, or close to saturation. In one embodiment, h1=0.9. If the condition hmax<h1 is true (the highest peak is not saturated), then no further steps are performed, and the normalized histogram computed in step 218 represents the final histogram 230 for locating highest peaks and determining the pitch. The second comparison performed in step 220 is to determine if ntotal is less than nmin. If ntotal<nmin, then the normalized histogram from step 218 is used as the final histogram 230 without performing further steps. A constant predetermined number nmin defines a minimal allowed number of vector pairs selected for computing a periodicity histogram. The value of nmin is chosen to guarantee that the histogram peaks are always statistically reliable. For example, in the particular embodiment nmin=400, and the other parameters are as follows: m=3, d=10, N=200, plow=40 and phigh=160.

If none of the conditions in step 220 are true, then the first adjustment is performed in step 222: the integer variable n is set equal to nmin, and n closest pairs of vectors are selected from the set of ntotal pairs obtained in step 216. Selecting n closest pairs from the set of ntotal pairs is accomplished by ordering (sorting) the set of ntotal vector pairs by a distance in state space to form an ordered set of vector pairs, and selecting n closest pairs from this ordered set. Then, a normalized periodicity histogram is computed with the n selected closest pairs and the magnitude hmax of the highest histogram peak (in the valid histogram interval plow<k<phigh) is determined in step 224. The determined hmax is compared to the constant value h0 in step 226. In one embodiment, h0=0.8. If hmax>h0, then the highest histogram peak has sufficient magnitude, and the normalized histogram computed in step 224 is output as the final histogram 230 without performing further steps.

If the condition in step 226 is not true, then the second adjustment is performed in step 228: the value of n is increased and n closest pairs are selected from the set of ntotal pairs. The new value of n must be less than ntotal. For example, in one particular embodiment the new value of n is calculated as n=(n+ntotal)/2 (rounded to the nearest lower integer). A normalized periodicity histogram is re-computed in step 224 with the new set of n selected closest pairs.

In one embodiment of the invention, the process is stopped here and the obtained normalized periodicity histogram is output as the final histogram 230. In other embodiments, the iteration loop 232 can be repeated several times, or until the condition 226 is satisfied. In each iteration, the number of the selected closest pairs n is increased, the normalized histogram is re-computed with the new number of selected closest pairs, and the highest peak's magnitude hmax is compared to h0.

The final normalized periodicity histogram 230 is used for identifying highest peaks and determining pitch.

Identifying Highest Histogram Peaks:

In accordance with the method of the present invention, the computed periodicity histogram is searched for highest peaks, e.g., largest local maximums, in order to determine a fundamental period of a signal.

In one embodiment of the invention, the periodicity histogram of EQ. 4 is used to identify the highest peak (the largest maximum) in the predetermined interval of possible pitch period values plow<k<phigh. As discussed above, the peak-searching interval between plow and phigh should exclude the regions close to both left and right histogram edges. The position of the identified highest peak, given by its corresponding value of k, represents the pitch period value in samples.

In the exemplary embodiment of the invention, the normalized periodicity histogram of EQ. 5 is used to identify one or more highest peaks. The magnitude hmax of the highest peak in the search interval plow<k<phigh is determined. A threshold level thld is then set equal to a predetermined fraction fr of the highest peak's magnitude: thld=fr*hmax. In the particular embodiment, fr=0.5, so that the threshold level is set at the half of the highest peak's magnitude. Then, all histogram peaks, or local maximums, with their magnitudes exceeding the threshold level thld are identified. The positions and, in some embodiments, magnitudes of the identified peaks can be retained for further analysis.

FIG. 6A illustrates application of the above-described method of identifying highest histogram peaks as applied to the normalized periodicity histogram computed for a transitional voiced speech segment. Vertical lines 61 and 62 define the lower bound plow and the upper bound phigh, respectively, of the pitch search interval. The highest peak 65 inside this search interval is identified first, and the threshold level 63 is set at the fraction of the highest peak's magnitude. Then, all local peaks higher than the threshold level 63 are identified. In addition to the highest peak 65, peaks 66, 67 and 68 are found to be higher than the threshold level.

The positions of the identified highest peaks 65, 66, 68 and 67 can be used as pitch period candidates in a post-processing stage. For clean periodic frames only peaks corresponding to a true pitch period and its integer multiples are usually identified as described above. For such periodic frames a simple selection of the lowest sub-multiple can give a reliable pitch period estimate. For real speech signals, including periodic as well as transitional and non-periodic portions, it is desirable to perform some type of post-processing, taking more than one consecutive frame into account.

Post-Processing:

After obtaining a periodicity histogram and identifying highest histogram peaks for individual successive speech frames, a post-processing technique can be employed to determine a final sequence of pitch values and/or to determine whether each particular frame is periodic (voiced) or aperiodic (unvoiced). Although the method of the present invention can produce reliable pitch estimates for clean and steady periodic frames, some form of post-processing is usually desirable for real speech signals. Post-processing allows more reliable pitch determination for frames with less than perfect periodicity, for example, transitional or noisy speech frames. Post-processing can also be useful when one desires to reliably determine voicing state transitions in speech signals.

Post-processing can include analyzing positions and/or magnitudes of the identified histogram peaks for each individual frame. Post-processing can also include analyzing identified histogram peaks in a larger temporal context by taking more than one consecutive frame into account.

The actual type of post-processing employed for a given application will, to some extent, be a function of the application's requirements. For example, the maximal allowed processing delay is a critical factor for many real-time speech-processing applications, like speech-coding devices.

Various different post-processing methods, commonly used with other short-term pitch-determination methods, can also be used with the method of the present invention. For example, one can determine a final pitch value for each frame independently of other frames and, then, apply a median-smoothing technique to the obtained sequence of pitch values, in order to filter out possible incorrect values. One of the most successful and popular approaches to the joint determination of pitch and voicing parameters is dynamic programming. For example, the dynamic-programming algorithm, used in conjunction with the known correlation-based pitch-estimation procedure, utilizes positions and magnitudes of the highest peaks in the correlation function, in order to determine an optimal pitch track and, at the same time, to detect voicing state transitions (Talkin, D., "A robust algorithm for pitch tracking (RAPT)", in *Speech Coding and Synthesis*, Elsevier, 1995, pp. 495–518). Dynamic programming can and in various embodiments does, serve as the basis for a variety of different possible post-processing methods used with the present invention.

One feature of the present invention is directed to a simple and efficient post-processing method, which involves simultaneous pitch tracking and voiced/unvoiced segmentation of speech signals with a minimal processing delay.

Reliable and Unreliable Frames:

For clean and steady periodic frames (like the one in FIG. 1A), the highest peaks identified in the normalized periodicity histogram usually include only peaks corresponding to a fundamental pitch period and its integer multiples. Such frames, characterized by a high degree of periodicity, are immediately classified as voiced frames in some embodiments of the present invention. The located peak positions (in number of samples) for such periodic frames are approximately related to each other as small integers 1, 2, 3 etc. The pitch period value is then given by the position of the peak corresponding to 1 (the lowest sub-multiple). However, for other frames, characterized by less than perfect periodicity (like the transitional voiced frame in FIG. 4A), the identified histogram peaks can also include secondary peaks caused by speech formants, and the located peak positions can deviate significantly from a simple sequence of the integer multiples of some number. For such frames, pitch can be determined more reliably by analyzing available information in a larger temporal context, that is, by examining past and future frames. The availability of the information about future frames to the pitch-tracking procedure assumes that a final decision about pitch and voicing is delayed by one or more frames.

In accordance with one embodiment of the invention, each speech frame is characterized as either reliable or unreliable. Speech frame is defined to be reliable if the positions of all identified highest peaks in the normalized periodicity histogram form a simple arithmetic series, like 1, 2, 3 etc. Thus, if more than one histogram peak is identified, positions of the second, third and so on peaks (in number of samples) must be given by the integer multiples of the first peak's position. For example, if the positions of 3 identified histogram peaks, numbered from left to right, are given by p1, p2 and p3, then, the following conditions are tested: p2/p1=2 and p3/p1=3. In practice, some small deviations of the ratios from the exact integer values are allowed, for example, 5 percent. Since all identified peaks are located in the valid pitch search range plow<k<phigh, reliable frames can have from one up to some number nmax of peaks, where nmax is determined by plow and phigh. For example, in one particular embodiment, plow=40 and phigh=160, and, therefore, reliable frames can have 1, 2 or 3 peaks.

Additional conditions can also be included in the definition of a reliable speech frame. For example, in one embodiment the energy of a reliable frame must exceed some predetermined threshold value. However, one should understand that the energy threshold is not a rigid value and may need to be properly adjusted in each particular case. Another condition, which can be included in the definition of a reliable frame, is the minimal allowed magnitude hmin of the highest peak in the normalized periodicity histogram computed with an appropriately selected neighborhood radius r. The optimal value of hmin in this case is dependent upon how the radius r is selected. In one particular embodiment, a reliable frame is required to have the magnitude of the highest peak in the normalized periodicity histogram greater than hmin=0.6, and the histogram is computed using the adaptive procedure of FIG. 11 with rmax=0.2.

If a frame satisfies the above conditions, it is determined to be reliable. If the above conditions are not satisfied, the frame is determined to be unreliable. A binary reliable/unreliable decision is made for each successive frame and stored for a subsequent use by a pitch-tracking procedure.

Figure 12:
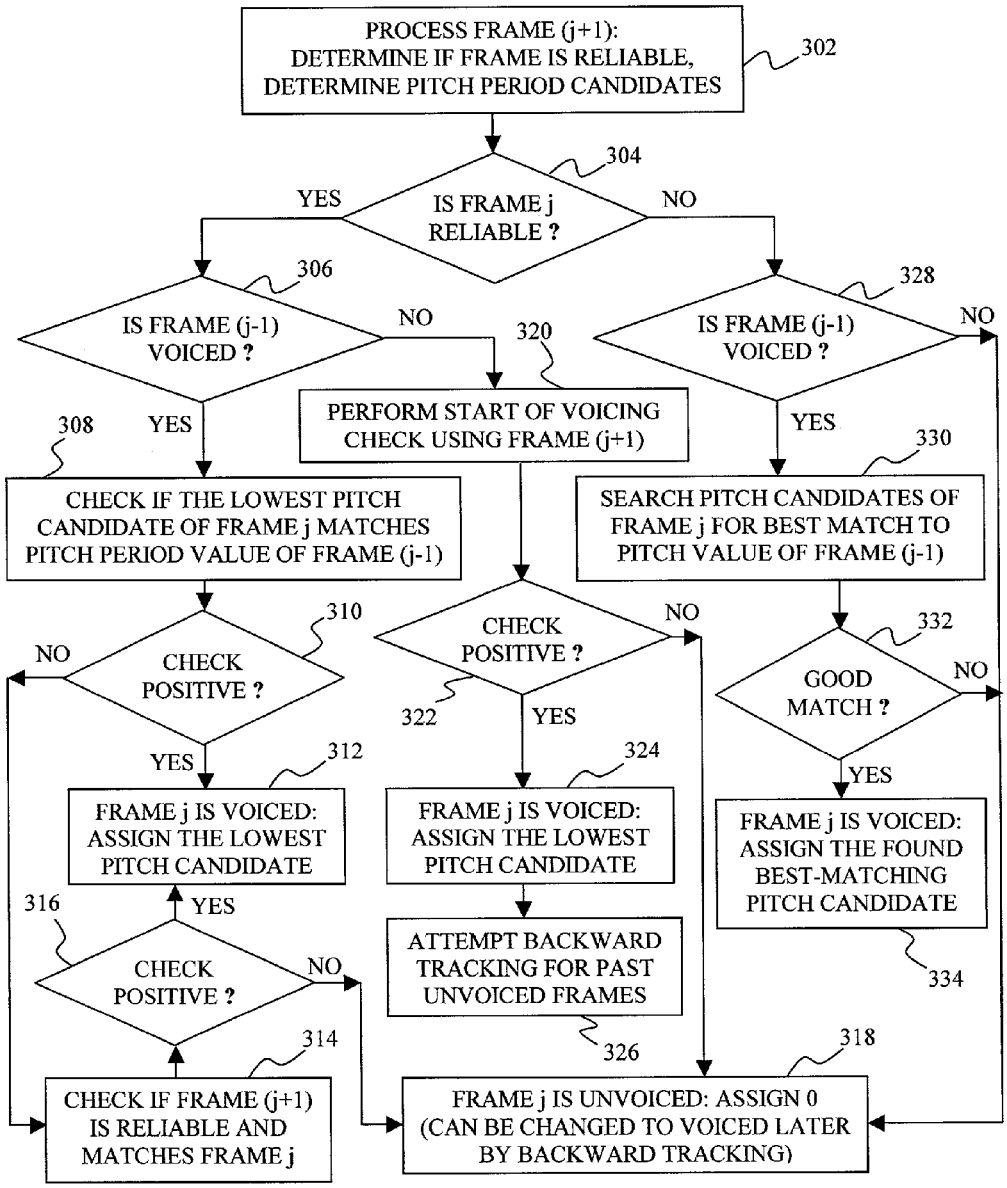
FIG. 12 is a flowchart of the pitch-tracking method according to one particular embodiment of the invention.

Pitch Tracking:

The steps of a pitch-tracking method implemented in accordance with one embodiment of the invention are shown in the flowchart of FIG. 12. The method determines a final sequence of pitch values and classifies each frame as either voiced or unvoiced. A final pitch value is assigned to each voiced frame. A zero value is assigned to each unvoiced frame.

The method operates with a minimal delay of one frame. Thus, in order to determine pitch and voicing for frame j, information about the next frame (j+1) is required by the pitch tracking method.

The flowchart of FIG. 12 describes pitch and voicing analysis cycle for frame j. Before performing pitch and voicing analysis for frame j, frame (j+1) is processed in step 302. Processing frame (j+1) includes computing a normalized periodicity histogram and identifying highest histogram peaks. Next, a determination is made whether frame (j+1) is reliable or not. A binary reliable/unreliable decision for frame (j+1) is stored for further processing. If frame (j+1) is reliable, then the located positions of all identified histogram peaks are stored as pitch period candidates in increasing order of their values (in number of samples). If frame (j+1) is unreliable, then all identified histogram peaks are ordered in decreasing order of their magnitudes, and npmax largest peaks are selected from the ordered set of peaks. If a total number of identified peaks is less than npmax, all of them are selected. The located positions of up to npmax selected peaks become pitch period candidates for frame (j+1). In one particular embodiment, npmax=10.

The analysis of frame j begins at step 304 by checking whether frame j is reliable or not. This information is available from the previous analysis cycle, when the frame index j was less by one. If frame j is reliable, then the next check is performed in step 306 whether frame (j−1) is voiced or unvoiced. The pitch period value and voicing state for frame (j−1) are available from the previous cycle. If frame (j−1) is voiced, then the check is performed in step 308 whether the lowest pitch period candidate of frame j matches the pitch period value of frame (j−1). In this description of the pitch-tracking method, two pitch period values are determined to match and are classified as "matching" if their absolute difference is less than some predetermined value pdiff. Under normal conditions, pitch values for two adjacent voiced frames should match because of the continuity of pitch in voiced portions of speech signals. In one particular embodiment, pdiff=6 samples, and the other parameters are as follows: frame size N=200 samples, frame step is 100 samples and sampling frequency is 16 kHz. If the check in step 308 is positive, the decision is made in step 310 to proceed to a final step 312. In the final step 312 frame j is declared voiced and the lowest pitch period candidate of frame j becomes its final determined pitch period value.

If the check in step 308 is negative, the decision is made in step 310 to proceed to step 314. In step 314 a check is performed whether the future frame (j+1) is reliable and matches frame j. If frame (j+1) is found reliable, then its lowest pitch candidate is compared to the lowest pitch candidate of frame j to determine if they match. If the check in step 314 is positive, the decision is made in step 316 to proceed to the final step 312. If the check in step 314 is negative, the decision is made in step 316 to proceed to a final step 318. In step 318, frame j is declared unvoiced and is assigned a zero value for the pitch period. It should be noted at this point that an unvoiced decision for frame j can be changed to voiced later by performing a backward-tracking operation in future analysis cycles.

If frame (j−1) is determined to be unvoiced in step 306, the decision is made to go to step 320. In step 320 a "start of voicing" check is performed. In one particular embodiment, the start of voicing condition is determined when two consecutive reliable frames are detected after an unvoiced frame, provided that the lowest pitch candidates for the two reliable frames match. Accordingly, the future frame (j+1) is checked in step 320 to see if it is reliable and if the lowest pitch period candidates for frames j and (j+1) match. If the start of voicing check in step 320 is positive, the decision is made in step 322 to proceed to step 324. In step 324 frame j is declared voiced and the lowest pitch period candidate becomes its final pitch period value. Next, a backward-tracking procedure is initiated in step 326. The backward-tracking procedure attempts to continue pitch tracking from the current voiced frame j to past frames (j−1), (j−2) and so on, which were previously determined to be unvoiced. First, pitch candidates of frame (j−1) are searched for best match to the current pitch value of frame j. If the found best match does not differ from the current pitch value by more than pdiff, then frame (j−1) is declared voiced and the found best-matching candidate becomes the final pitch period value for frame (j−1). This backward-searching operation can be repeated for frames (j−2), (j−3) and so on, until no good match can be found. In practice, the maximal allowed processing delay puts a limit on the number of frames to be considered in the backward-searching operation.

If the start of voicing check in step 320 is negative, the decision is made in step 322 to proceed to the final step 318.

If frame j is found unreliable in step 304, a check is performed in step 328 to determine whether frame (j−1) is voiced or unvoiced. If frame (j−1) is determined to be voiced, a forward-searching operation is performed in step 330: pitch period candidates of frame j are searched for best match to the pitch period value of the previous frame (j−1). If the found best-matching candidate does not differ from the previous pitch period value by more than pdiff, then the decision is made in step 332 to go to a final step 334. In step 334 frame j is declared voiced and the found best-matching pitch candidate becomes the final pitch period value. If no good match can be found in step 330, the decision is made in step 332 to go to the final step 318.

After the analysis cycle described by FIG. 12 is finished, frame index j is incremented by one, and the cycle is started again. Since the analysis cycle for frame j needs information about the previously determined pitch period and voicing state for frame (j−1), the very first frame in the sequence can be initially declared unvoiced and assigned a zero for its pitch period value.

The obtained pitch period values can be converted into fundamental frequency values. Fundamental frequency, or F0, is defined as the inverse of a fundamental pitch period. Thus, in order to obtain a fundamental frequency value of a voiced frame, one should divide the sampling frequency by the pitch period in number of samples. For unvoiced frames, fundamental frequency is assigned a zero value. Rather than perform an actual division operation a lookup table can be used to convert between pitch period values and fundamental frequency values.

Figure 13A:
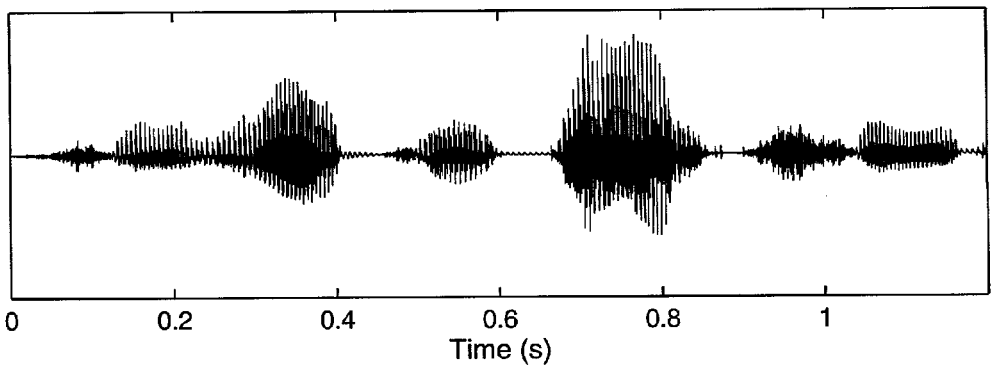
FIG. 13A illustrates a speech signal waveform for the male-spoken utterance "She had your dark suit" sampled at 16 kHz.
Figure 13B:
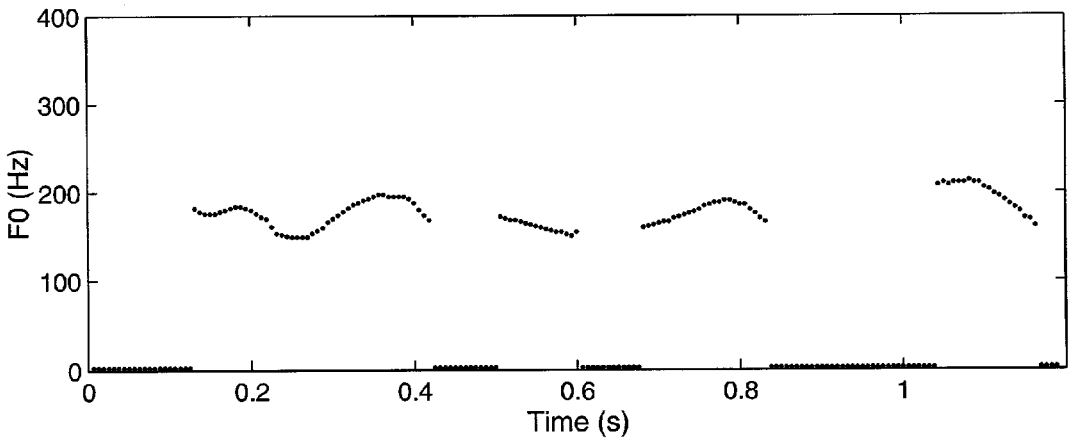
FIG. 13B illustrates fundamental frequency contours obtained with the method of the present invention for the speech signal waveform illustrated in FIG. 13A.

FIG. 13A shows speech signal waveform of the male-spoken utterance "She had your dark suit" sampled at 16 kHz. FIG. 13B shows a corresponding output of the pitch-tracking method, where each dot represents a fundamental frequency value for an individual speech frame. For some applications the obtained F0 tracks may need to be further smoothed by applying some form of smoothing or best-fitting operation to successive pitch values. Such processing is contemplated and within the scope of the invention.

Alternative Embedding Procedures:

The embedding procedure used in the exemplary embodiment of the invention is time-delay embedding. Time-delay embedding (or the method of delays, as it is called elsewhere) is the most widely used, but not the only known method of transforming a scalar one-dimensional signal into a trajectory in multi-dimensional space. Other embedding procedures can be used, in accordance with the invention, in place of time-delay embedding to reconstruct a state-space trajectory, as long as topological properties of the original state space of a system are preserved. This means, in particular, that the reconstructed trajectory of a periodic signal should repeat itself after a complete period.

For example, one can take a signal and its first, second and so on derivatives as independent dimensions in state space, in order to reconstruct a state-space trajectory. However, this simple technique works well only for ideal signals and suffers from noise for real speech signals because of a signal-to-noise ratio's degradation after each differentiation.

In another example, one can take a signal and its Hilbert transform to form an analytic signal, which can be represented as a trajectory on a two-dimensional plane.

One particular alternative embedding procedure, used in one embodiment of the invention, is singular value decomposition (SVD) embedding. SVD-embedding was originally introduced for qualitative analysis of chaotic time-series (D. S. Broomhead and G. King, "Extracting qualitative dynamics from experimental data", *Physica D,* 20, 1986, pp. 217–236).

To embed a signal frame of N samples s(i) (i=1 . . . N) using SVD-embedding, the frame is first embedded using time-delay embedding with the delay parameter d and the embedding dimension of P (A DC-component should be removed prior to embedding by subtracting a mean signal value). P is called SVD-window length and is usually chosen much larger than the number of dimensions m retained in the final SVD-embedding. In one embodiment, d=1, P=20 and m=3.

The resulting trajectory matrix X has P columns and N−(P−1)d rows:

$$X = \begin{matrix} \{s(1) & s(1+d) & \dots & s(1+(P-1)d)\} \\ \{s(2) & s(2+d) & \dots & s(2+(P-1)d)\} \\ \{\dots & \dots & \dots & \dots \quad \} \\ \{s(N-(P-1)d) & s(N-(P-2)d) & \dots & s(N) \quad \} \end{matrix} \qquad \text{EQ. 6}$$

A singular value decomposition of the matrix X can be represented as $$X=USV^T \qquad \text{EQ. 7}$$

where S is a diagonal matrix containing singular values p1>p2>p3 . . . >0 in decreasing order; U and V are orthogonal matrices containing corresponding singular vectors.

The first m columns of V corresponding to largest singular values are selected and stored in $V^r$.

The reduced trajectory matrix $X^r$ is obtained as follows:

$$X^r=XV^r \qquad \text{EQ. 8}$$

Matrix $X^r$ contains the final SVD-embedding of a signal frame s(i) (i=1 . . . N) in m dimensions, where only m most significant components are retained. The M rows of $X^r$ (where M=N−(P−1)d) represent a sequence of m-dimensional vectors x(i) (i=1 . . . M) in state space:

$$X^r = \begin{matrix} \{x(1)\} \\ \{x(2)\} \\ \{\ \dots\ \} \\ \{x(M)\} \end{matrix} \qquad \text{EQ. 9}$$

Figure 14A:
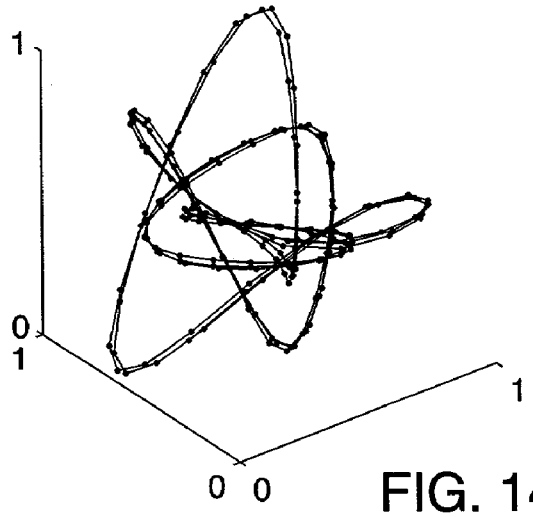
FIGS. 14A, 14B and 14C illustrate results of an SVD-embedding for the speech frames illustrated in FIGS. 1A, 4A and 7A, respectively.
Figure 14B:
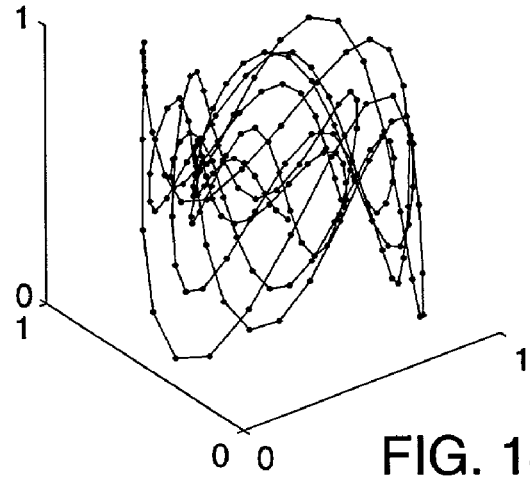
Figure 14C:
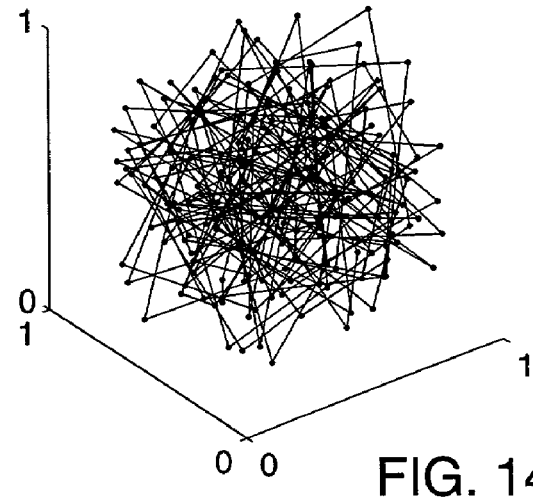

FIGS. 14A, 14B and 14C illustrate results of SVD-embedding in three dimensions of the speech frames shown in FIGS. 1A, 4A and 7A, respectively (In all cases, P=20). From these illustrations it is evident that SVD-embedding preserves the topological properties of the original state space of a system. Therefore, SVD-embedding can be a viable alternative to time-delay embedding.

Using SVD-embedding instead of time-delay embedding can be advantageous for noisy signals and some particular types of speech sounds (e.g. voiced fricatives) because of its smoothing capabilities. Smooth trajectories in state space result in a smooth periodicity histogram and, as a consequence, in better peak discrimination. However, in many cases a smoothing effect can be achieved without using SVD-embedding, by simply performing low-pass filtering of an input signal prior to its time-delay embedding.

The computational cost and memory requirements of SVD-embedding procedure are usually significantly higher compared to time-delay embedding. This makes SVD-embedding somewhat less practical for many real-time implementations.

It is important to note that the method of the present invention can produce valid results even without embedding a signal into a multi-dimensional state space. This is because the multi-dimensional embedding of a scalar signal does not contain more information than the signal itself.

A periodicity histogram can be computed based on absolute differences between pairs of samples, instead of distances between pairs of vectors in state space:

$$hist(k) = \sum_{i=1}^{i=N-k} H(r - |s(i) - s(i+k)|) \quad \text{EQ. 10}$$

where s(i) (i=1 . . . N) is a sequence of signal samples representing a frame of N samples.

In order to keep the same terminology, it is convenient to say that the method of the present invention remains valid when the embedding dimension m becomes equal to one, and to define one-dimensional embedding as a trivial transformation of a signal to itself. In this limiting case, one can say that signal samples play the role of m-dimensional vectors, and that Euclidean distances in state space turn into absolute differences between sample values.

The accuracy and reliability of the method, however, are significantly degraded on real speech signals when m=1. This degradation is caused by "false nearest neighbors" (in the terminology of chaos theory) due to signal under-embedding. False nearest neighbors usually disappear when the embedding dimension m is increased to some appropriate value (for example, three).

Figure 15A:
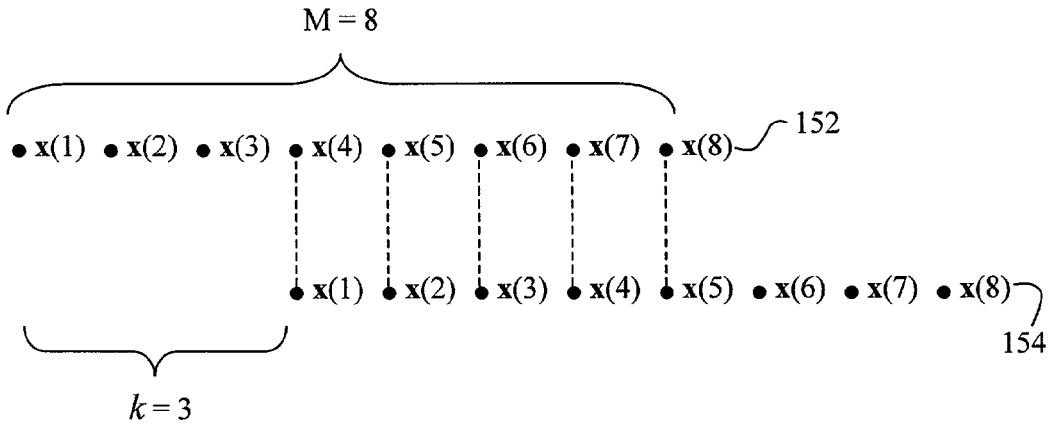
FIG. 15A illustrates a method of generating all possible pairs of vectors for selecting the closest pairs according to one exemplary embodiment of the invention.

Modified Periodicity Histogram:

In one exemplary embodiment of the invention, closest pairs of vectors in state space are selected from all possible non-repeating combinations of two vectors from the sequence of m-dimensional vectors x(i) (i=1 . . . M). In practice, the number of possible pairs may be reduced to include only pairs with time separations in the predetermined interval of possible pitch periods. The procedure of generating all possible non-repeating pairs of vectors, which corresponds to the definition of a periodicity histogram in EQ. 4, can be better understood using the schematic illustration in FIG. 15A. The upper row of dots 152 represents the sequence of vectors x(i) (i=1 . . . M) (In this example, M=8). To obtain all possible pairs of vectors with time separations equal to k, one can shift the sequence against itself by k vectors and take the matching vectors from the original sequence and from its shifted version to form pairs of vectors. In FIG. 15A, the lower row of dots 154 represents the shifted version of the original sequence 152, where it is shifted by k=3 to the right. By shifting the original sequence by each of the possible time separation values k, one can form all possible pairs of vectors. A total number of possible pairs of vectors with time separations of k is equal to (M−k) and decreases linearly with increasing k. In FIG. 15A, 5 pairs are obtained for k=3, shown by the vertical dashed lines. This decrease is reflected in the linearly shrinking summation interval in EQ. 4. The decreasing number of pairs leads to a fall-off of the histogram peaks as k is increased, and causes the histogram bins with larger indices k near M to be statistically unreliable. Normalizing each bin of the periodicity histogram in accordance with EQ. 5 prevents a fall-off of peak magnitudes at larger k, but does not make all bins statistically equally reliable. In particular, the normalized histogram of EQ. 5 has a large variance at larger bin indices k approaching M, as the number of pairs involved in computing corresponding histogram bins becomes small. It is interesting to observe some analogy here with the conventional definitions of biased and unbiased auto-correlation functions.

Figure 15B:
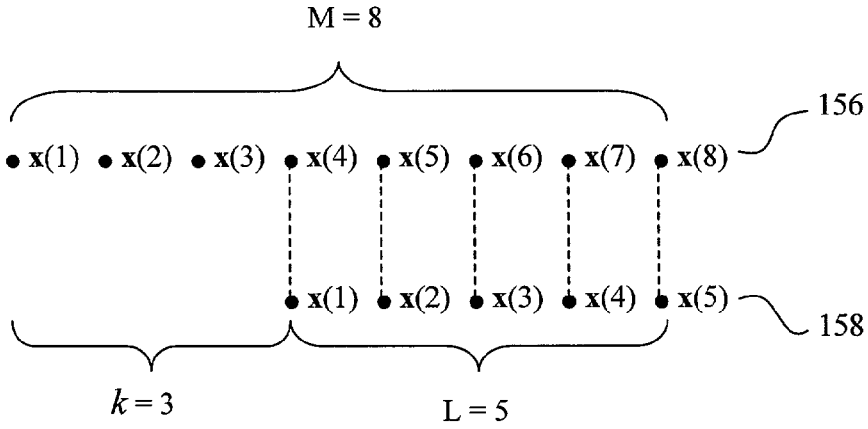
FIG. 15B illustrates a method of generating a subset of all possible pairs of vectors for selecting the closest pairs in accordance with one alternative embodiment of the invention.

In one alternative embodiment of the invention, the set of all possible pairs of vectors in the sequence x(i) (i=1 . . . M) is reduced to a subset of pairs, which includes the same number L of pairs for each time separation value k. The procedure of generating this subset of pairs can be better understood using the schematic illustration in FIG. 15B. The upper row of dots 156 represents the sequence of vectors x(i) (i=1 . . . M). The lower row of dots 158 represents a subsequence of the sequence 156. The subsequence 158 is selected from the beginning of the sequence 156 and includes L vectors, where L<M (In this example, L=5). Shifting the subsequence of vectors 158 inside the sequence 156 by k, one can generate L pairs of vectors for each time separation value k. The shifted subsequence 158 must remain inside the sequence 156, so that the maximal amount of shift, or the maximal possible time separation between vectors, is k=M−L. In FIG. 15B, the subsequence 158 is shown in the position corresponding to the maximal shift of k=3. In practice, the value of L should be chosen to allow sufficient shift of the subsequence 158 inside the sequence 156, but at the same time to include enough vectors in the subsequence 158, for example, L=M/2.

The procedure of forming a subset of all possible pairs in the sequence of vectors x(i) (i=1 . . . M), including the same number of pairs L for each time separation value k, corresponds to the formal definition of a modified periodicity histogram:

$$mhist(k) = \frac{1}{L}\sum_{i=1}^{i=L} H(r - D[x(i), x(i+k)]) \quad \text{EQ. 11}$$

In this modified histogram definition, the summation interval is the same for all k, so that an equal number of pairs is involved in calculating each bin value. All histogram peaks are thus normalized with respect to the same constant number and are equally reliable statistically. The modified periodicity histogram is used in place of the normalized periodicity histogram in one embodiment of the invention. The peak-searching interval in the modified histogram can be extended to the right edge, since all histogram bins are now equally reliable.

Smoothing of Periodicity Histogram:

In contrast to smooth and wide peaks of the correlation function, the peaks in the periodicity histogram are usually much sharper and can have a rough appearance in many cases. This can be observed, for example, in FIGS. 5C, 6A and 6B. The rough appearance can cause undesirable effects in some cases when histogram peaks are identified, especially with noisy signals. In particular, additional local maxima can sometimes be detected in the vicinity of an identified large peak. Therefore, in order to facilitate peak discrimination, it can be advantageous to obtain a smoothed histogram before searching for local peaks.

One way to obtain a smoothed periodicity histogram is to start with a smooth trajectory in m-dimensional state-space, provided the employed sampling rate is sufficient. Smooth trajectory can be obtained by performing low-pass filtering of the input signal before embedding it. Alternatively, SVD-embedding procedure can be used with an appropriately chosen SVD-window length.

Once the histogram is obtained, it can be smoothed using any of the conventional smoothing methods. In one embodiment, for example, a simple 3-point moving-average smoothing procedure is used for this purpose. In fact, any suitable smoothing or curve-fitting procedure can be applied to a histogram, in order to achieve more reliable peak discrimination.

An alternative approach is to apply some averaging operation to a distribution of spatio-temporal distances in the r direction. For example, a periodicity histogram can be computed several times, each time changing the value of r by some Δr. Then, a weighted average of these computed histograms can be used as a final smooth histogram for peak searching:

$$\text{finalhist}(k)=w1*\text{nhist}(k, r-\Delta r)+w2*\text{nhist}(k, r)+w3*\text{nhist}(k, r+\Delta r) \quad \text{EQ. 12}$$

Different smoothing procedures can also be combined in any suitable way to achieve the best results in each particular case.

Computational Efficiency Improvements:

The method of the present invention involves selecting closest pairs of vectors from a set of possible vector pairs formed in the sequence of M vectors in m-dimensional state space. According to one embodiment, M is the number of m-dimensional vectors obtained after embedding a signal frame. Thus, the value of M is proportional to a sampling rate and to a frame size, and is typically a few hundred. In the particular embodiment, M=180 (when N=200, m=3 and d=10). Closest pairs of vectors can be easily found in a straightforward way by computing distances between vectors in state space for all possible pairs of vectors and comparing all computed distances to the predetermined value of r, or to each other.

However, the number of required computations grows as $M^2$. Thus, increasing a frame size and/or a sampling rate has a significant impact on the performance of the method, if all possible spatial distances are computed. Therefore, it can be advantageous to avoid explicit computation of all possible distances in state space by using more sophisticated methods of searching for closest pairs of vectors in state space.

Finding nearest-neighbor points in multi-dimensional space is an extensively studied subject in computational geometry. Nearest-neighbor search is also one of the frequently encountered tasks in nonlinear and chaotic time-series analysis (e.g. Schreiber, T., "Efficient neighbor searching in nonlinear time series analysis", *Int. J. Bifurcation and Chaos,* 5, 1995, p. 349). A number of fast neighbor-searching algorithms have been developed to date. The two most popular approaches, described in the literature, are tree-based search methods and box-assisted search methods. Although any suitable algorithm can be used in connection with the present invention, the selection of best-performing algorithm depends on many factors, such as signal properties, embedding dimension, sampling rate etc. For example, with low sampling rate and/or small number of samples in a frame, the value of M is small, and a simple computation of all distances may actually be cheaper than using a sophisticated fast algorithm.

Another effective method of reducing computational cost is to compute a periodicity histogram using a down-sampled version of a signal first. This down-sampled version of a histogram is searched for highest peaks in the full pitch search range (between plow and phigh search bounds). After the highest peaks are identified, the histogram is computed at the original sampling rate, but only in the vicinity of the identified highest peaks. The peak positions are then determined more accurately.

CONCLUSIONS

Thus, the present invention provides a reliable, accurate and efficient method for determining pitch and/or periodicity of speech signals. The invention also provides an efficient method for pitch tracking and/or for performing segmentation of speech signals into voiced and unvoiced portions.

As part of the method of the present invention, a pitch period value may be generated. In the context of the present application a pitch period value is to be interpreted as a value that is indicative of the fundamental period of a signal or a portion of a signal.

Figure 16:
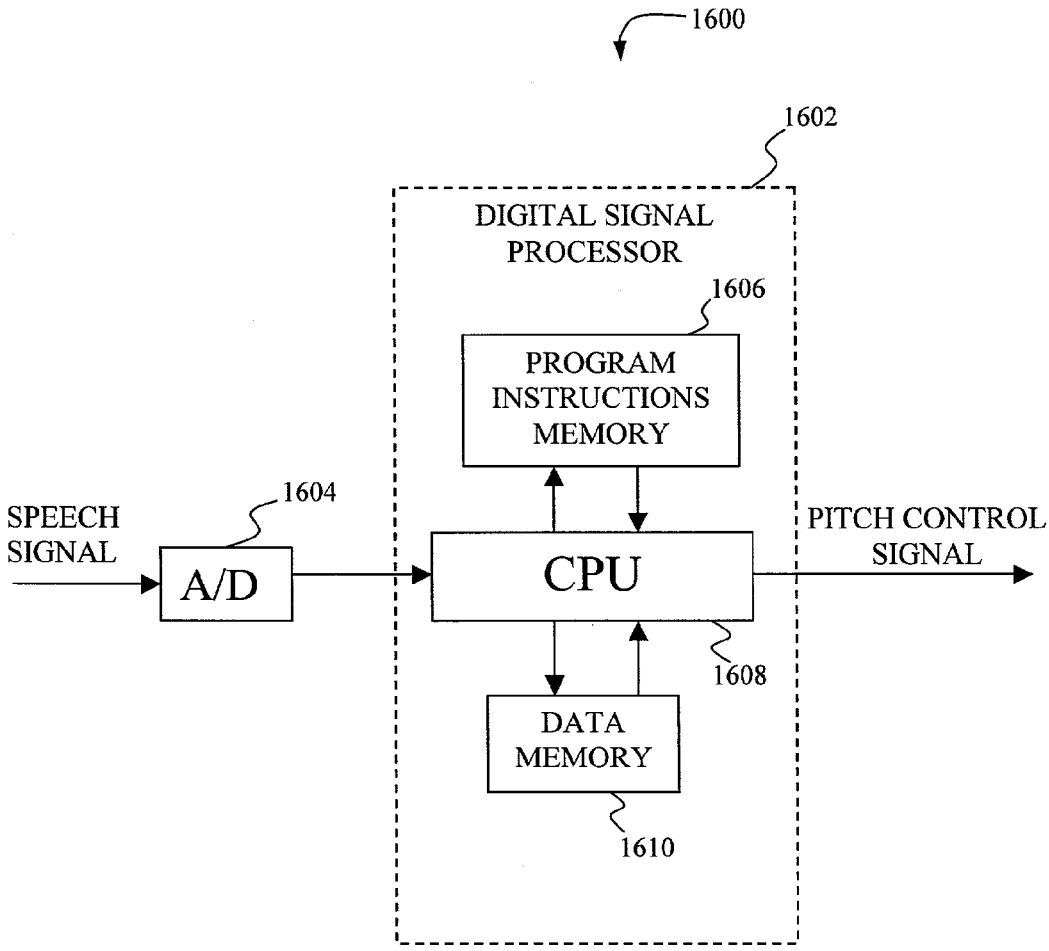
FIG. 16 is a schematic block diagram of a pitch-determination apparatus in accordance with the present invention.

The invention can be implemented in software, hardware, or any combination of software and hardware. For example, FIG. 16 illustrates a schematic block diagram of a pitch determination apparatus 1600 in the form of a digital signal processor 1602 used in conjunction with an analog to digital converter 1604, which can also include other parts and can itself be included in any device. For example, the digital signal processor 1602 may be used as a pitch detector in a speech-coding device, a speech recognition system, a speaker recognition system and a speech synthesis system.

The digital signal processor 1602 includes a CPU 1608 for executing instructions included in the software of the present invention. The software is stored in program instructions memory 1606. The digital signal processor 1602 receives digitized speech from the A/D converter 1604, processes it in accordance with the present invention, and outputs a resulting pitch signal which assumes a value indicative of the detected pitch of the speech signal at a particular point in time. The CPU 1608 may use data memory 1610 to store samples, vectors and/or other values used as part of the pitch determination method of the present invention.

In the case of software, the invention can be embodied in a set of machine readable instructions stored on a digital data storage device such as a RAM, ROM or disk type of storage. When executed, the machine readable instructions in the software of the invention, control a processor and/or other hardware to perform the steps of the present invention.

Although the illustrative embodiments and operation of the invention are described in particular relation to speech signals, the invention has a much broader nature. The methods, described above in connection with pitch determination of speech signals, can be used equally well to detect periodicity and/or to determine fundamental period of any signal.

It is to be understood that various changes and modifications may be affected therein by one skilled in the art without departing from the scope or spirit of the invention.

The scope of the invention should be determined by the claims and their legal equivalents, rather than by the illustrative embodiments discussed above.

What is claimed is:

1. A method for determining the pitch of a sampled digitized speech signal, comprising the steps of:

embedding a portion of the sampled digitized speech signal into an m-dimensional state space to obtain a sequence of m-dimensional vectors;

selecting closest pairs of vectors in state space from a plurality of possible pairs of m-dimensional vectors in said sequence of m-dimensional vectors;

accumulating a total number of the selected closest pairs of vectors for each of a plurality of time separation values to produce a histogram of accumulated numbers; and locating at least a highest peak in a portion of said histogram to obtain a pitch period value for said portion of the sampled digitized speech signal.

2. The method of claim 1, wherein said portion of the sampled digitized speech signal is a frame including a predetermined number of samples.

3. The method of claim 2, further comprising:

generating a plurality of sequential frames from said sampled digitized speech signal; and performing, each of said embedding, selecting, accumulating, and locating steps on each of said sequential frames.

4. The method of claim 1, wherein said embedding is time-delay embedding.

5. The method of claim 4, further comprising normalizing sample values to a predetermined range of values prior to performing said time-delay embedding.

6. The method of claim 4, wherein said time-delay embedding has a constant embedding dimension in a range of two through five.

7. The method of claim 6, wherein said time-delay embedding has a constant embedding dimension of three.

8. The method of claim 4, wherein said time-delay embedding has a constant delay parameter equal to a predetermined number of samples.

9. The method of claim 1, wherein said embedding is singular value decomposition embedding.

10. The method of claim 1, wherein said plurality of possible pairs of m-dimensional vectors includes all possible non-repeating combinations of two vectors from said sequence of m-dimensional vectors.

11. The method of claim 10, wherein said all possible non-repeating combinations of two vectors include only pairs of m-dimensional vectors with time separations between vectors in a predetermined interval of value.

12. The method of claim 1, wherein said plurality of possible pairs of m-dimensional vectors is a sub-set of all possible non-repeating combinations of two vectors from said sequence of m-dimensional vectors, wherein said subset is generated by:

selecting a subsequence of vectors from said sequence of m-dimensional vectors, said subsequence including a predetermined number of vectors less than the number of vectors in said sequence of m-dimensional vectors;

shifting said subsequence relative to said sequence of m-dimensional vectors by each of a plurality of possible time separation values; and matching vectors in said shifted subsequence with vectors in said sequence of m-dimensional vectors to form pairs of m-dimensional vectors, one element of each pair being from the shifted subsequence and one element being from said sequence of m-dimensional vectors.

13. The method of claim 12, wherein said sub-set of all possible non-repeating combinations of two vectors includes only pairs of m-dimensional vectors with time separations between vectors in a predetermined interval of values.

14. The method of claim 1, wherein said sequence of m-dimensional vectors defines a trajectory in m-dimensional state space, the method further comprising the step of:

performing a linear transformation on each dimension of said trajectory to scale said trajectory to a predetermined size prior to performing said selecting step.

15. The method of claim 1, wherein said step of selecting closest pairs of vectors in state space includes selecting pairs of vectors with a distance between vectors less than a predetermined value of a neighborhood radius.

16. The method of claim 15, wherein said step of selecting pairs of vectors with a distance between vectors less than said predetermined value of a neighborhood radius further includes:

computing a distance between m-dimensional vectors for each pair of vectors in the plurality of possible pairs of vectors; and comparing all computed distances with the predetermined value of a neighborhood radius.

17. The method of claim 13, wherein said distance between vectors is one of a Euclidean distance and a squared Euclidean distance in m-dimensional space.

18. The method of claim 15, wherein said distance between vectors is one of a one-norm distance and a max-norm distance.

19. The method of claim 1, wherein said step of selecting closest pairs of vectors in state space includes selecting a predetermined number of vector pairs having the smallest distances in state space.

20. The method of claim 19, wherein said step of selecting a predetermined number of vector pairs further comprises:

computing a distance between m-dimensional vectors for each pair of vectors in the plurality of possible pairs of m-dimensional vectors;

ordering the pairs as a function of the computed distances to form an ordered set; and selecting the predetermined number of vector pairs from the ordered set.

21. The method of claim 19, wherein said distance between vectors is one of a Euclidean distance and a squared Euclidean distance in m-dimensional space.

22. The method of claim 19, wherein said distance between vectors is one of a one-norm distance and a max-norm distance.

23. The method of claim 1, further comprising the step of normalizing each accumulated number in the histogram with respect to the total number of pairs with the same time separation in said plurality of possible pairs of m-dimensional vectors in said sequence of m-dimensional vectors.

24. The method of claim 1, further comprising performing a smoothing operation on said histogram prior to performing said locating step.

25. The method of claim 1, wherein said step of locating at least a highest peak further comprises:

locating all peaks exceeding a predetermined threshold value.

26. The method of claim 1, wherein said step of locating at least a highest peak further comprises:

locating all peaks exceeding a threshold determined as a function of the magnitude of the highest peak.

27. A method for determining if a portion of a signal is periodic, comprising:

transforming said portion of said signal into a sequence of m-dimensional vectors;

selecting closest pairs of vectors from a plurality of possible pairs of m-dimensional vectors in said sequence of m-dimensional vectors;

accumulating total numbers of the selected closest pairs of vectors having same time separation values to produce a histogram of accumulated numbers;

identifying highest peaks in a predetermined interval of said histogram, each identified highest peak having a corresponding position value; and determining said portion of said signal to be periodic when the position values of the identified highest peaks in said histogram are integer multiples or approximately integer multiples of the position value of the identified peak with the lowest position value.

28. The method of claim 27, wherein said method further comprises determining the fundamental period for said portion of said signal as the position value of said identified peak with the lowest position value.

29. The method of claim 27, further comprising the step of normalizing each accumulated number in said histogram with respect to the total number of pairs with the same time separation value in said plurality of possible pairs of m-dimensional vectors in said sequence of m-dimensional vectors.

30. The method of claim 27, wherein said step of transforming said portion of said signal includes performing an embedding operation.

31. The method of claim 27, wherein said step of identifying highest peaks includes identifying all peaks exceeding a threshold determined as a function of the magnitude of the highest peak in said predetermined interval of said histogram.

32. A method for estimating a fundamental period of a signal having periodicity, comprising the steps of:

transforming a sequence of signal samples into a sequence of m-dimensional vectors;

selecting closest pairs of vectors in a plurality of possible pairs of m-dimensional vectors in said sequence of m-dimensional vectors;

accumulating a total number of the selected closest pairs of vectors for each of a plurality of time separation values to produce a histogram of accumulated numbers; and locating at least a highest peak in a portion of said histogram to obtain the fundamental period value for said sequence of said signal samples.

33. The method of claim 32, wherein said step of transforming a sequence of said signal samples includes performing an embedding operation.

34. The method of claim 33, wherein said embedding operation is one of a time delay embedding operation and a singular value decomposition embedding operation.

35. The method of claim 32, further comprising:

conditionally repeating said selecting and accumulating steps, prior to performing said locating step, as a function of a magnitude of the highest peak in the portion of said histogram.

36. The method of claim 35, wherein said step of conditionally repeating includes repeating said selecting and accumulating steps when the magnitude of the highest peak is outside a predetermined range.

37. The method of claim 32, wherein said signal is an audio signal.

38. In a speech processing system, a pitch detector comprising:

a transformer module for transforming a sequence of input signal samples into a sequence of m-dimensional vectors;

a selector module for selecting closest pairs of vectors in a plurality of possible pairs of vectors in said sequence of m-dimensional vectors;

an accumulator module for accumulating total numbers of the selected closest pairs of vectors with same time separations between vectors to obtain an array of accumulated numbers; and a maxima locator module for locating at least one maximum in a distribution described by a portion of said array of accumulated numbers, wherein a position of the located maximum in said array provides an estimate of a pitch period.

39. The pitch detector of claim 38, further comprising:

a processor for executing software instructions; and wherein said transformer, said selector, said accumulator and said maxima locator modules each include software executable computer instructions.

40. The pitch detector of claim 38, wherein the speech processing system is a speech coder.

41. The pitch detector of claim 38, wherein the speech processing system is a speech recognition system.

42. The pitch detector of claim 38, wherein the speech processing system is a speaker recognition system.

43. The pitch detector of claim 38, wherein the speech processing system is a speech synthesis system.

44. An apparatus for determining the fundamental period of a sampled digitized signal, comprising:

means for embedding a portion of the sampled digitized signal into an m-dimensional state space to obtain a sequence of m-dimensional vectors;

means for selecting closest pairs of vectors in state space from a plurality of possible pairs of m-dimensional vectors in said sequence of m-dimensional vectors;

means for accumulating a total number of the selected closest pairs of vectors for each of a plurality of time separation values to generate a histogram of accumulated numbers; and means for locating at least a highest peak in a portion of said histogram to produce a fundamental period value for said portion of the sampled digitized signal.

45. The method of claim 44, wherein said sampled digitized signal is an audio signal.

46. A machine readable medium comprising computer executable instructions for controlling a computer to perform the steps of:

embedding a portion of a sampled digitized signal into an m-dimensional state space to obtain a sequence of m-dimensional vectors;

selecting closest pairs of vectors in state space from a plurality of possible pairs of m-dimensional vectors in said sequence of m-dimensional vectors;

accumulating a total number of the selected closest pairs of vectors for each of a plurality of time separation values to generate a histogram of accumulated numbers; and locating at least a highest peak in a portion of said histogram to produce a fundamental period value for said portion of the sampled digitized signal.

47. A method for estimating a fundamental frequency of a signal including a plurality of samples, comprising the steps of:

transforming a sequence of said signal samples into a sequence of m-dimensional vectors;

selecting closest pairs of vectors in a plurality of possible pairs of m-dimensional vectors in said sequence or m-dimensional vectors;

generating an array of accumulated numbers by calculating total numbers of the selected closest pairs of vectors with same time separations between vectors in samples;

identifying at least one maximum in a distribution described by said array of accumulated numbers; and determining the fundamental frequency of said signal from at least said identified one maximum.

48. The method of claim 47, wherein said step of transforming a sequence of said signal samples includes performing an embedding operation.

49. The method of claim 48, wherein said embedding operation is one of a time delay embedding operation and a singular value decomposition embedding operation.

50. The method of claim 47, wherein said signal is an audio signal.

51. A method for determining a fundamental period of a portion of a signal, comprising the steps of:

forming m-dimensional vectors x(i) from a sequence of signal samples, where i is an integer index;

selecting pairs of vectors {x(i),x(i+k)} with smallest distances D[x(i),x(i+k)] between vectors from a plurality of possible pairs of said m-dimensional vectors, where k is an integer time separation value;

computing a histogram of the distribution of the time separation values k for the selected pairs of vectors; and searching said histogram for at least one peak to determine the fundamental period of said portion of said signal.

52. The method of claim 51, wherein said m-dimensional vectors x(i) are formed from said sequence of signal samples using time-delay embedding operation:

$$x(i)=\{s(i),\ s(i-d),\ s(i-2d),\ \ldots\ s(i-(m-1)d)\},$$

where m is the embedding dimension and d is the delay parameter.

53. The method of claim 51, wherein said histogram, hist(k), is computed according to the following definition:

$$\mathrm{hist}(k)=\Sigma H(r-D[x(i),\ x(i+k)]),$$

wherein H is a unit-step function, D[x(i),x(i+k)] is a spatial distance between vectors x(i) and x(i+k) in m-dimensional distance norm, and r is a chosen value of a neighborhood radius.

54. The method of claim 53, wherein the value of r is adaptively chosen as a function of a magnitude of a peak in said histogram.

55. The method of claim 51, further comprising: performing a pre-processing operation on said signal prior to performing said step of forming m-dimensional vectors.

56. The method of claim 55, wherein said pre-processing operation includes performing low-pass filtering of said signal.

57. The method of claim 51, wherein said signal is a speech signal and said fundamental period is a pitch period.

58. A method for determining a fundamental period of a portion of a signal, comprising the steps of:

selecting pairs of signal samples {s(i), s(i+k)} with smallest absolute differences |s(i)−s(i+k)| from a plurality of possible pairs of samples of said portion of said signal, where i is an integer index and k is an integer time separation value;

computing a histogram of the distribution of the time separation values k for the selected pairs of samples; and searching said histogram for at least one peak to determine the fundamental period of said portion of said signal.

59. The method of claim 58, wherein said histogram, hist(k), is computed according to the following definition:

$$\mathrm{hist}(k)=\Sigma H(r-|s(i)-s(i+k)|),$$

wherein H is a unit-step function and r is a chosen value of a neighborhood radius.

60. The method of claim 59, wherein the value of r is adaptively chosen as a function of a magnitude of a peak in said histogram.

61. The method of claim 58, further comprising: performing a pre-processing operation on said signal prior to performing said steps of selecting pairs of samples and computing a histogram.

62. The method of claim 61, wherein said pre-processing operation includes performing low-pass filtering of said signal.

* * * * *